US011047373B2

(12) United States Patent
Kanai et al.

(10) Patent No.: US 11,047,373 B2
(45) Date of Patent: Jun. 29, 2021

(54) PISTON COMPRESSOR INCLUDING A SUCTION THROTTLE

(71) Applicant: KABUSHIKI KAISHA TOYOTA JIDOSHOKKI, Aichi (JP)

(72) Inventors: Akinobu Kanai, Aichi-ken (JP); Shinya Yamamoto, Aichi-ken (JP); Yoshinori Inoue, Aichi-ken (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 82 days.

(21) Appl. No.: 16/366,301

(22) Filed: Mar. 27, 2019

(65) Prior Publication Data

US 2019/0301439 A1 Oct. 3, 2019

(30) Foreign Application Priority Data

Mar. 30, 2018 (JP) ..... JP2018-068570
Mar. 22, 2019 (JP) ..... JP2019-054599

(51) Int. Cl.
*F04B 27/18* (2006.01)
*F04B 27/10* (2006.01)
*F04B 39/10* (2006.01)

(52) U.S. Cl.
CPC ..... *F04B 27/1804* (2013.01); *F04B 27/1063* (2013.01); *F04B 39/10* (2013.01);
(Continued)

(58) Field of Classification Search
CPC .... F04B 27/08; F04B 27/0808; F04B 27/086; F04B 27/10; F04B 27/1018;
(Continued)

(56) References Cited

U.S. PATENT DOCUMENTS 5,362,208 A 11/1994 Inagaki et al.
5,380,165 A * 1/1995 Kimura ..... F01B 3/02 417/269

(Continued)

FOREIGN PATENT DOCUMENTS

JP H05-306680 11/1993
JP H05-312145 11/1993
JP H07-119631 5/1995

*Primary Examiner* — Charles G Freay
*Assistant Examiner* — Chirag Jariwala
(74) *Attorney, Agent, or Firm* — Greenblum & Bernstein, P.L.C.

(57) ABSTRACT

A piston compressor includes a housing including a cylinder block having cylinder bores. The housing has a discharge chamber, a swash plate chamber, and an axial hole. The piston compressor includes a drive shaft, a fixed swash plate, a piston, a discharge valve, a rotating body, and a control valve. The rotating body has a second communication passage that communicates with first communication passages intermittently by rotation of the drive shaft. A flow rate of refrigerant gas discharged from the compression chambers into the discharge chamber decreases when a communication angle around the axis becomes large per a rotation of the drive shaft depending on a position of the rotating body in the direction of the axis. The piston compressor includes a suction throttle that decreases the flow rate of refrigerant gas in the compression chamber when the communication angle becomes large based on the control pressure.

7 Claims, 15 Drawing Sheets

(52) U.S. Cl.
CPC ..... *F04B 2027/1818* (2013.01); *F04B 2027/1822* (2013.01)

(58) Field of Classification Search
CPC ..... F04B 27/1063; F04B 27/14; F04B 27/16; F04B 27/18; F04B 27/1804; F04B 27/22; F04B 39/10; F04B 49/08; F04B 49/22; F04B 49/225; F04B 2027/1818; F04B 2027/1822
USPC ..... 417/212, 218, 269, 272, 273; 91/499, 91/504
See application file for complete search history.

(56) References Cited

U.S. PATENT DOCUMENTS 5,478,212 A * 12/1995 Sakai ..... F04B 27/1018 417/222.2
2015/0184646 A1* 7/2015 Fukazawa ..... F04B 27/1804 137/535

* cited by examiner

UPPER
REAR
LOWER
FRONT

PISTON COMPRESSOR INCLUDING A SUCTION THROTTLE

CROSS-REFERENCE TO RELATED APPLICATION

This application claims priority to Japanese Patent Application No. 2018-068570 filed on Mar. 30, 2018 and Japanese Patent Application No. 2019-054599 filed on Mar. 22, 2019, the entire disclosure of which is incorporated herein by reference.

BACKGROUND ART

The present disclosure relates to a piston compressor.

Japanese Patent Application Publication No. 5-306680 discloses a conventional piston compressor (hereinafter referred to merely as "compressor") in the drawings of No. 1 and No. 10 in the above Publication. The compressor includes a housing, a drive shaft, a fixed swash plate, a plurality of pistons, a discharge valve, a control valve, and a rotating body.

The housing includes a cylinder block. The cylinder block has a plurality of cylinder bores and a first communication passage communicating with the cylinder bores. The housing has a discharge chamber, a swash plate chamber, an axial hole, and a control pressure chamber. The swash plate chamber also serves as a suction chamber for introducing refrigerant from the outside of the compressor. The swash plate chamber communicates with the axial hole.

The drive shaft is rotatably supported in the axial hole. The fixed swash plate is rotatable by the rotation of the drive shaft in the swash plate chamber. The inclination angle of the fixed swash plate is constant with respect to the plane perpendicular to the drive shaft. Each piston forms a compression chamber in the cylinder bore and coupled to the fixed swash plate. A reed type discharge valve is provided between the compression chamber and the discharge chamber to discharge refrigerant in the compression chamber into the discharge chamber. The control valve controls the pressure of refrigerant so as to serve as control pressure.

The rotating body is provided on the outer peripheral surface of the drive shaft and disposed in the axial hole. The rotating body partitions the suction chamber and the control pressure chamber. The rotating body is rotatable integrally with the drive shaft in the axial hole and movable based on the control pressure in the axial direction of the drive shaft with respect to the drive shaft. A second communication passage is formed on the outer peripheral surface of the rotating body. The second communication passage intermittently communicates with the first communication passage in accordance with the rotation of the drive shaft. The second communication passage has a small formed portion and a large formed portion on the outer circumferential surface of the rotating body in the circumferential direction of the rotating body.

As each piston of the compressor reciprocates in the cylinder bore, an intake stroke for sucking the refrigerant, a compression stroke for compressing the sucked refrigerant, and a discharge stroke for discharging the compressed refrigerant are performed in the compression chamber. In accordance with the position in the axial direction of the rotating body of the compressor, the compressor can change the communication angle around the axis through which the first communication passage and the second communication passage communicate with each other per one rotation of the drive shaft. Thus, in the compressor, the flow rate of the refrigerant discharged from the compression chamber to the discharge chamber can be changed.

Specifically, when the rotating body moves in the axial hole in the axial direction and a portion of the second communicating passage, which is formed small in the circumferential direction on the outer circumferential surface of the rotating body, communicates with the first communicating passage, the communication angle becomes small. In the case, when the piston moves from the top dead center to the bottom dead center, refrigerant in the swash plate chamber is sucked into the compression chamber from the second communication passage through the first communication passage. When the piston moves from the bottom dead center to the top dead center, the second communication passage and the first communication passage are disconnected from each other. As a result, the sucked refrigerant is compressed in the compression chamber. Then, the compressed refrigerant is discharged to the discharge chamber.

On the other hand, when a portion of the second communicating passage, which is formed large in the circumferential direction on the outer circumferential surface of the rotating body, communicates with the first communication passage, the communication angle becomes large. In the case, not only while the piston moves from the top dead center to the bottom dead center, but also while the piston moves to a certain extent from the bottom dead center to the top dead center, the first communication passage and the second communication passage communicate with each other. For the reason, part of the refrigerant sucked into the compression chamber while the piston moves from the top dead center to the bottom dead center is discharged from the compression chamber to the upstream side of the compression chamber when the piston moves from the bottom dead center to the top dead center. When the piston approaches the top dead center, the first communication passage and the second communication passage are disconnected from each other. Thus, the flow rate of refrigerant compressed in the compression chamber decreases, so that the flow rate of refrigerant discharged from the compression chamber to the discharge chamber decreases as compared to the case in which the communication angle is small.

However, in the above-described conventional compressor, when the rotating body moves in the axial direction to change the communication angle around the axis between the first communication passage and the second communication passage from a small state to a large state, the flow rate of the refrigerant discharged from the compression chamber to the discharge chamber hardly decreases. Thus, the controllability of the compressor hardly increases. In particular, in an operating state in which the fixed swash plate rotates at a high speed, the first communication passage and the second communication passage are disconnected from each other before the refrigerant sucked into the compression chamber is sufficiently discharged to the upstream side of the compression chamber and the refrigerant is compressed in the compression chamber. Therefore, when the communication angle is changed from the small state to the large state, the flow rate of the refrigerant discharged from the compression chamber to the discharge chamber becomes hardly decreases more prominently.

The present disclosure, which has been made in light of such circumstances, is directed to providing a piston compressor that has excellent controllability.

SUMMARY

In accordance with an aspect of the present invention, there is provided a piston compressor including a housing including a cylinder block having a plurality of cylinder bores, having a discharge chamber, a swash plate chamber, and an axial hole, a drive shaft rotatably inserted into the axial hole and supported in the axial hole, a fixed swash plate rotatable together with the drive shaft in the swash plate chamber, wherein an inclination angle of the fixed swash plate with respect to a plane perpendicular to an axis of the drive shaft is constant, a piston forming a compression chamber in each cylinder bore and coupled to the fixed swash plate, a discharge valve discharging refrigerant gas in each compression chamber into the discharge chamber, a rotating body provided on the drive shaft and rotatable integrally with the drive shaft and movable in a direction of the axis of the drive shaft with respect to the drive shaft based on a control pressure, and a control valve configured to control the control pressure. The cylinder block has a plurality of first communication passages communicating with the respective cylinder bores. The rotating body has a second communication passage that communicates with the respective first communication passages intermittently by rotation of the drive shaft. A flow rate of refrigerant gas discharged from the compression chambers into the discharge chamber decreases when a communication angle around the axis, at which the second communication passage communicates with the respective first communication passages, becomes large per a rotation of the drive shaft depending on a position of the rotating body in the direction of the axis. The piston compressor includes a suction throttle that decreases the flow rate of refrigerant gas in the compression chamber when the communication angle becomes large based on the control pressure.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure together with objects and advantages thereof, may best be understood by reference to the following description of the presently preferred embodiments together with the accompanying drawings in which.

DETAILED DESCRIPTION OF THE EMBODIMENTS

The following will describe piston compressors according to a first embodiment through a fifth embodiment of the present disclosure with reference to the drawings. The compressors have a single headed piston. The compressors are mounted in a vehicle and constitute part of a refrigeration circuit of an air conditioner.

First Embodiment

Figure 1:
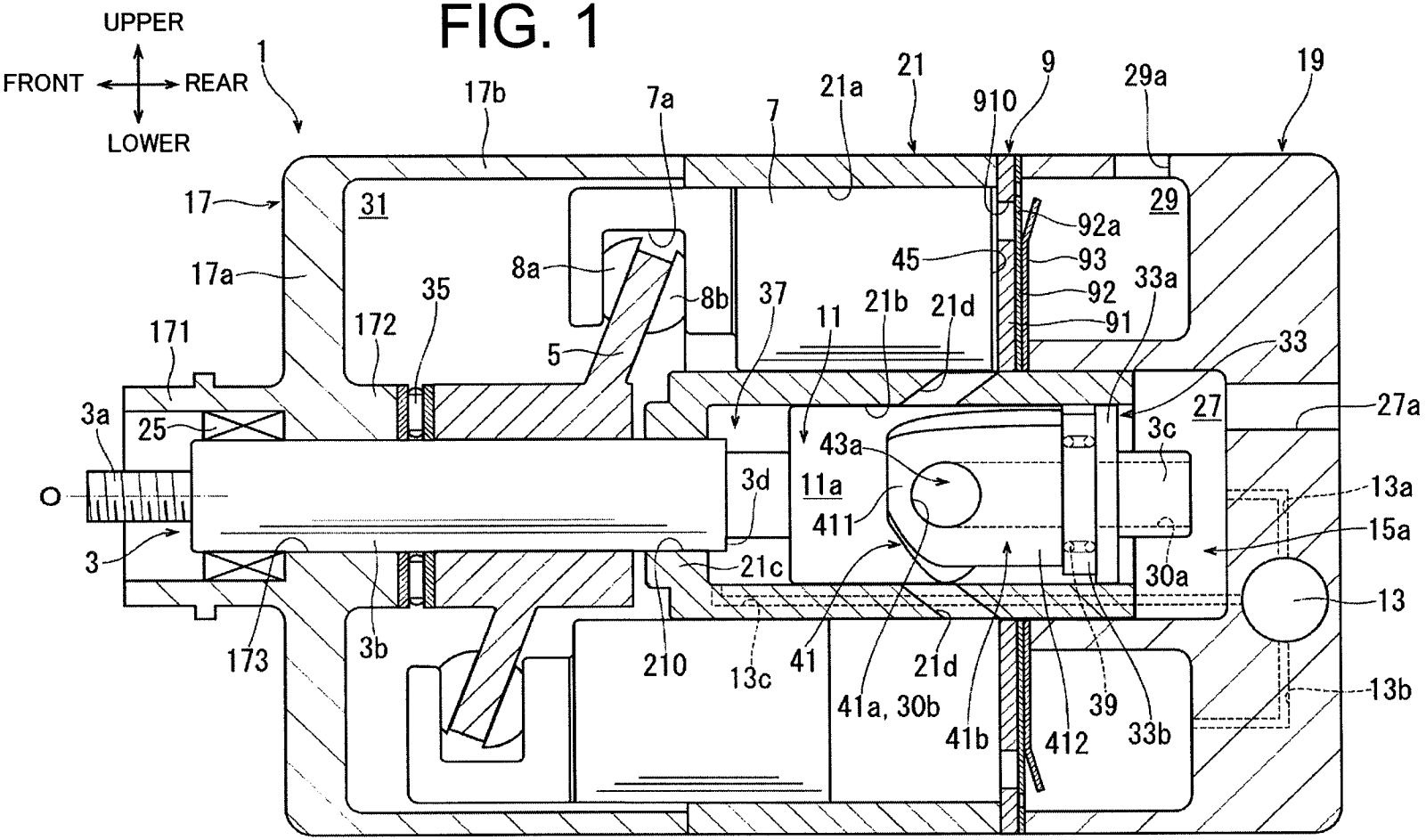
FIG. 1 is a longitudinal sectional view showing a piston compressor at a maximum flow rate, according to a first embodiment of the present disclosure.
Figure 2:
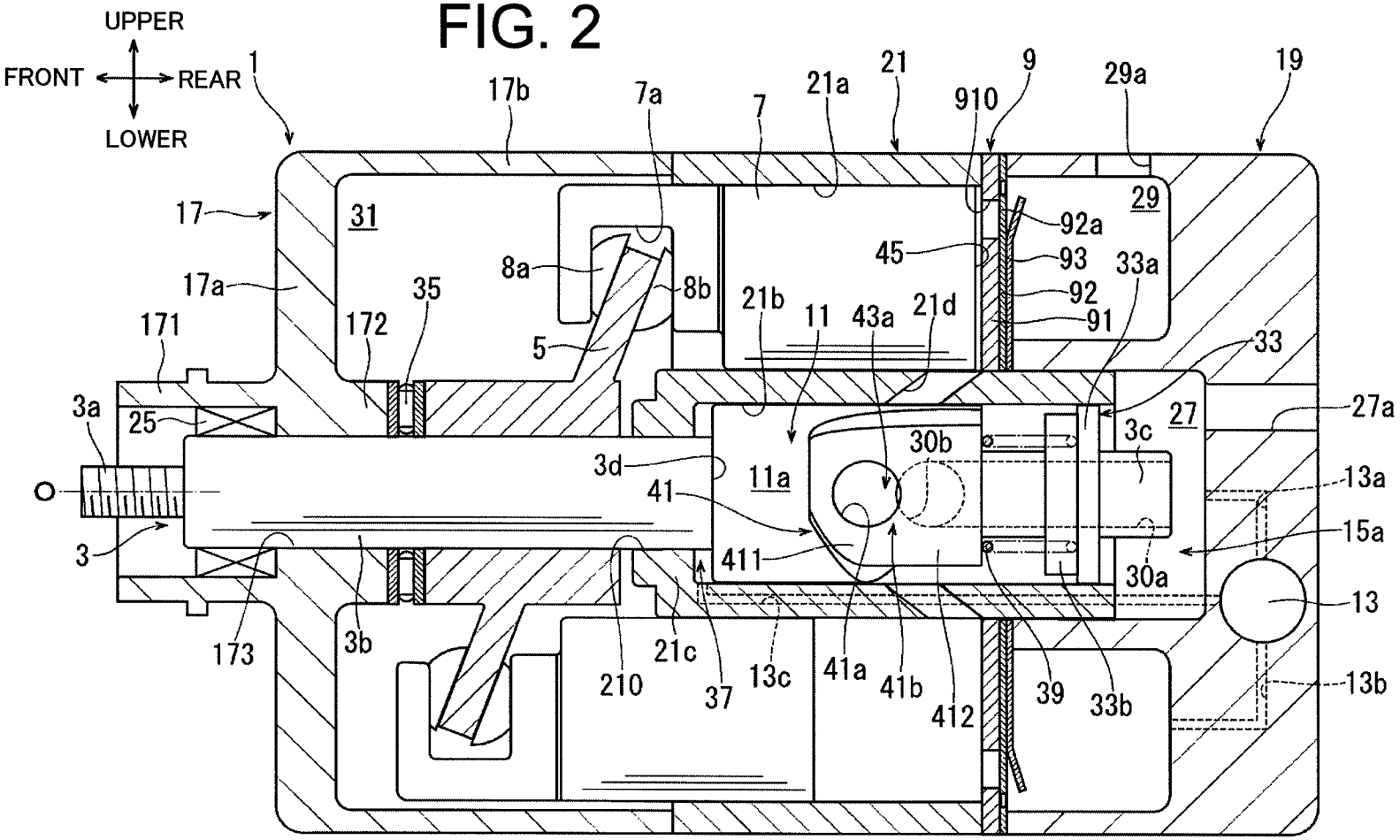
FIG. 2 is a longitudinal sectional view showing the piston compressor of FIG. 1 at a minimum flow rate.

Referring to FIGS. 1 and 2, a compressor according to a first embodiment of the present disclosure includes a housing 1, a drive shaft 3, a fixed swash plate 5, a plurality of pistons 7, a valve forming plate 9, a rotating body 11, a control valve 13, a suction unit 15*a*, and a suction throttle 43*a*. The valve forming plate 9 is an example of a discharge valve of the present disclosure.

Figure 3:
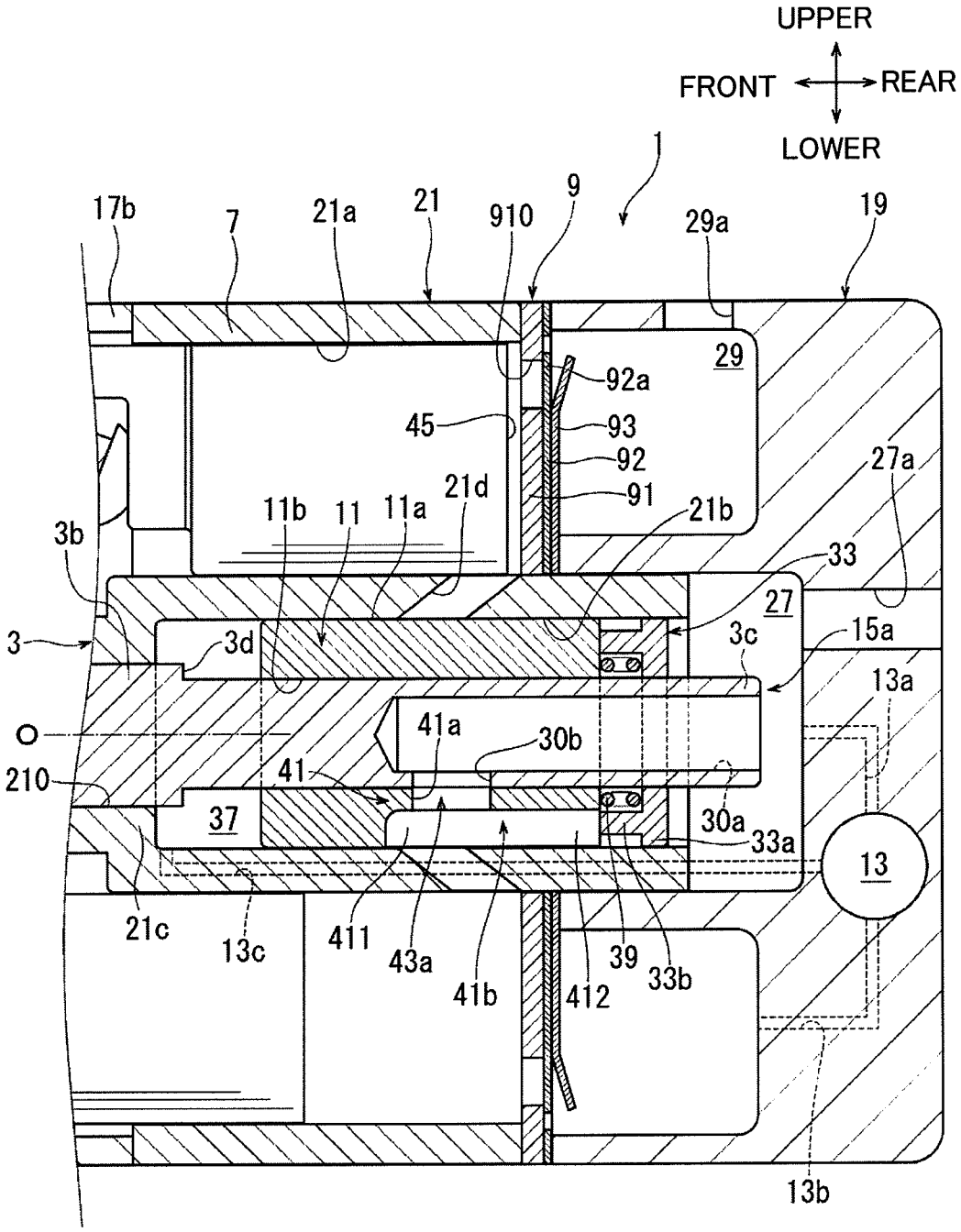
FIG. 3 is a partially enlarged longitudinal sectional view showing the piston compressor of FIG. 1 at a maximum flow rate.

The housing 1 has a front housing 17, a rear housing 19, and a cylinder block 21. In the present embodiment, the front housing 17 is located on the front side of the compressor and the rear housing 19 is located on the rear side of the compressor to define the front and rear direction of the compressor. The upper sides of the planes of FIGS. 1 and 2 are defined as the upper side of the compressor and the lower sides of the planes are defined as the lower side of the compressor to define the upper and lower direction of the compressor. In FIG. 3 and the following drawings, the front and rear direction and the upper and lower direction are displayed corresponding to FIGS. 1 and 2. The front and rear direction in the embodiment is merely examples. The position of the compressor according to embodiments in the present disclosure may be appropriately modified in accordance with a vehicle to be mounted.

The front housing 17 has a front wall 17*a* extending in the radial direction thereof and a substantially cylindrical-shaped circumferential wall 17*b* integrally formed with the front wall 17*a* and extending rearward in a direction of an axis O of the drive shaft 3 from the front wall 17*a*. The front wall 17*a* has a first boss portion 171, a second boss portion 172, and a first axial hole 173. The first boss portion 171 protrudes forward in the direction of the axis O. A shaft seal device 25 is provided in the first boss portion 171. The second boss portion 172 protrudes rearward in the direction of the axis O in the swash plate chamber 31 that is described later. The first axial hole 173 passes through the front wall 17*a* in the direction of the axis O.

The rear housing 19 has a suction chamber 27, a discharge chamber 29, a suction port 27*a*, and a discharge port 29*a*. The suction chamber 27 is located on the center side of the rear housing 19. The discharge chamber 29 is annularly formed and is located adjacent to the outer circumferential surface of the suction chamber 27. The suction port 27*a* communicates with the suction chamber 27 and extends in the rear housing 19 in the direction of the axis O and opens to the outside of the rear housing 19. The suction port 27*a* is connected to an evaporator via a pipe. Thus, low-pressure refrigerant gas passing through the evaporator is sucked into the suction chamber 27 through the suction port 27*a*. The discharge port 29*a* communicates with the discharge chamber 29 and extends in the radial direction of the rear housing 19 and opens to the outside of the rear housing 19. The discharge port 29*a* is connected to a condenser via a pipe. The illustration of the pipes, the evaporator, and the condenser is omitted.

The cylinder block 21 is located between the front housing 17 and the rear housing 19. The cylinder block 21 has a plurality of cylinder bores 21*a* extending in the direction of the axis O. Each of the cylinder bores 21*a* is arranged at equal angular intervals in the circumferential direction. The cylinder block 21 is joined to the front housing 17 to form a swash plate chamber 31 between the front wall 17*a* and the circumferential wall 17*b* of the front housing 17. The swash plate chamber 31 is in communication with the suction chamber 27 through an access passage (not shown). The number of the cylinder bores 21*a* may be appropriately modified.

The cylinder block 21 has a second axial hole 21*b*, a support wall 21*c*, and first communication passages 21*d* having the same number as the number of the cylinder bores 21*a*. The second axial hole 21*b* is located on the center side of the cylinder block 21 and extends in the direction of the axis O. The rear side of the second axial hole 21*b* is located in the suction chamber 27 by joining the cylinder block 21 to the rear housing 19 via the valve forming plate 9. As a result, the second axial hole 21*b* communicates with the suction chamber 27.

The support wall 21*c* is located on the center side of the cylinder block 21 and in front of the second axial hole 21*b*. The support wall 21*c* partitions the second axial hole 21*b* from the swash plate chamber 31. The support wall 21*c* has a third axial hole 210. The third axial hole 210 is coaxial with the first axial hole 173 and penetrates the support wall 21*c* in the direction of the axis O. The first to third axial holes 173, 21*b*, and 210 are examples of the axial hole of the present disclosure.

The first communication passages 21*d* communicate with the respective cylinder bores 21*a*. The first communication passages 21*d* extend in the radial direction of the cylinder block 21 and communicate with the cylinder bores 21*a* and the second axial holes 21*b*, respectively.

The valve forming plate 9 is provided between the rear housing 19 and the cylinder block 21. The rear housing 19 and the cylinder block 21 are joined via the valve forming plate 9.

The valve forming plate 9 is constituted by a valve plate 91, a discharge valve plate 92, and a retainer plate 93. The valve plate 91 has discharge holes 910 having the same number as the number of the cylinder bores 21*a*. The cylinder bores 21*a* communicate with the discharge chamber 29 through the respective discharge hole 910.

The discharge valve plate 92 is provided on the rear surface of the valve plate 91. The discharge valve plate 92 is provided with a plurality of discharge reed valves 92*a* that open and close the discharge holes 910 by elastic deformation. The retainer plate 93 is provided on the rear surface of the discharge valve plate 92. The retainer plate 93 regulates the maximum opening degree of the discharge reed valve 92*a*.

The drive shaft 3 extends from the front side toward the rear side of the housing 1 in the direction of the axis O. The drive shaft 3 has a threaded portion 3*a*, a first diameter portion 3*b*, and a second diameter portion 3*c*. The threaded portion 3*a* is located at the front end of the drive shaft 3. The drive shaft 3 is connected to a pulley and an electromagnetic clutch that are not shown in the drawing via the threaded portion 3*a*.

The first diameter portion 3*b* is continuously formed with the rear end of the threaded portion 3*a* and extends in the direction of the axis O. The second diameter portion 3*c* is continuously formed with the rear end of the first diameter portion 3*b* and extends in the direction of the axis O. The second diameter portion 3*c* has a smaller diameter than the first diameter portion 3*b*. Thus, the drive shaft 3 has a stepped portion 3*d* formed between the first diameter portion 3*b* and the second diameter portion 3*c*.

Referring to FIG. 3, the second diameter portion 3*c* has an axial passage 30*a* and a second radial passage 30*b*. The axial passage 30*a* extends in the direction of the axis O in the second diameter portion 3*c*. The rear end of the axial passage 30*a* opens to the rear surface of the second diameter portion 3*c*, or the rear surface of the drive shaft 3. The second radial passage 30*b* communicates with the axial passage 30*a*. The second radial passage 30*b* extends in the radial direction of the drive shaft 3 in the second diameter portion 3*c* and opens to the outer circumferential surface of the second diameter portion 3*c*.

A support part 33 is press-fitted to the rear side of the second diameter portion 3*c*. Thus, the support part 33 is rotatable together with the drive shaft 3 in the second axial hole 21*b*. The support part 33 is constituted by a flange portion 33*a* and a cylindrical portion 33*b*. The flange portion 33*a* is formed to have substantially the same diameter as the second axial hole 21*b*. The cylindrical portion 33*b* is formed to be slightly smaller in diameter than the flange portion 33*a*. The cylindrical portion 33*b* is integrally formed with the flange portion 33*a* and extends forward from the flange portion 33*a* in the direction of the axis O.

As shown in FIGS. 1 and 2, the first diameter portion 3*b* of the drive shaft 3 is inserted into the first axial hole 173 of the front housing 17 and the third axial hole 210 and rotatably supported in the first axial hole 173 and the third axial hole 210. That is the drive shaft 3 is inserted into the housing 1 and rotatably supported in the housing 1. The first diameter portion 3*b* is rotatable in the swash plate chamber 31. The second diameter portion 3*c* is located in the second axial hole 21*b* and is rotatable in the second axial hole 21*b*. The rear end of the second diameter portion 3*c* protrudes from the inside of the second axial hole 21*b* and extends into the suction chamber 27, so that the axial passage 30*a* is connected to the suction chamber 27 at the rear end. The support part 33 is disposed on the rear side of the second axial hole 21*b*, so that the flange portion 33*a* partitions the inside of the second axial hole 21*b* from the suction chamber 27.

In the first boss portion 171, the drive shaft 3 is inserted into the shaft seal device 25, so that the shaft seal device 25 seals the inside of the housing 1 from the outside of the housing 1.

The fixed swash plate 5 is press-fitted to the first diameter portion 3*b* of the drive shaft 3 and is disposed in the swash plate chamber 31. The fixed swash plate 5 is rotatable by the rotation of the drive shaft 3 in the swash plate chamber 31. The inclination angle of the fixed swash plate 5 with respect to the plane perpendicular to the axis of the drive shaft 3 is constant. In the swash plate chamber 31, a thrust bearing 35 is provided between the second boss portion 172 and the fixed swash plate 5.

The pistons 7 are accommodated in the respective cylinder bores 21*a*. Each piston 7 and the valve forming plate 9 form a compression chamber 45 in the cylinder bore 21*a*. An engaging portion 7*a* is formed in each piston 7. Semispherical shoes 8*a* and 8*b* are provided in the engaging portion 7*a*. The pistons 7 are coupled to the fixed swash plate 5 by the shoes 8*a* and 8*b*. The shoes 8*a* and 8*b* serve as a conversion unit for converting the rotation of the fixed swash plate 5 into the reciprocating motion of each piston 7. Each piston 7 can reciprocate in the cylinder bore 21*a* between the top dead center and the bottom dead center of the piston 7. Hereinafter, the top dead center and the bottom dead center of the piston 7 will be referred to as the top dead center and the bottom dead center, respectively.

As shown in FIG. 3, the rotating body 11 is provided in the second axial hole 21*b*. The rotating body 11 is formed in a substantially cylindrical shape and has an outer circumferential surface 11*a* and an inner circumferential surface 11*b*. The rotating body 11 is formed to have substantially the same outer diameter as the inner diameter of the second axial hole 21*b*. The inner circumferential surface 11*b* is insertable through the second diameter portion 3*c* of the drive shaft 3. The rotating body 11 is disposed in the second axial hole 21*b*, so that a control pressure chamber 37 is formed between the support wall 21*c* and the rotating body 11 in the second axial hole 21*b*.

Figure 4:
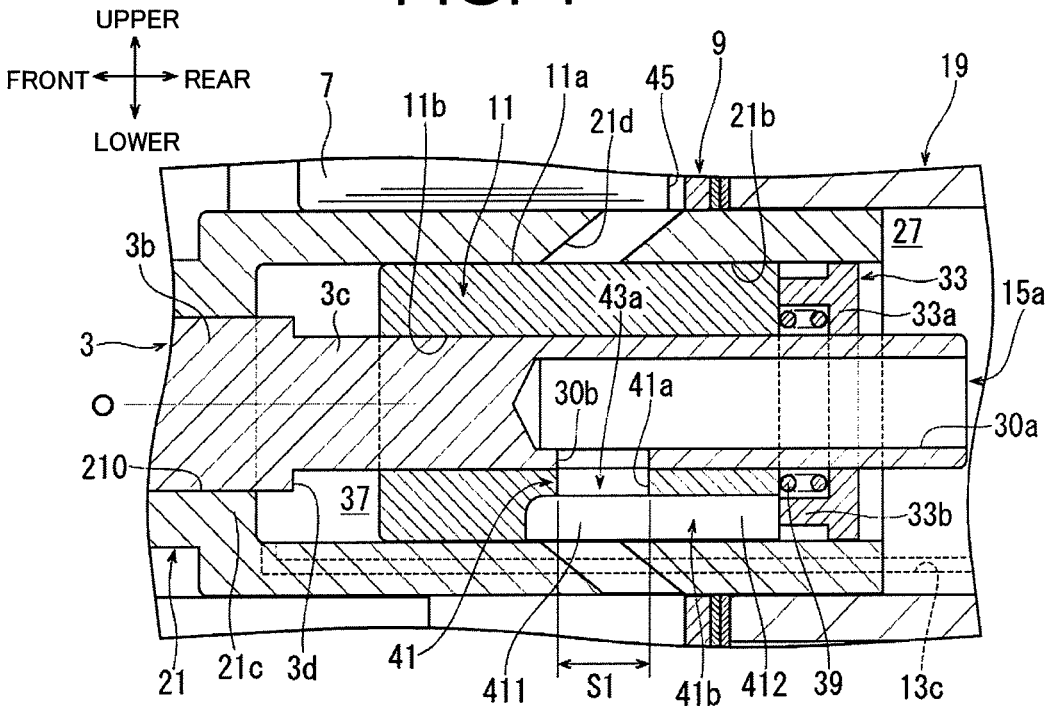
FIG. 4 is a partially enlarged longitudinal sectional view showing a suction throttle and its surroundings of the piston compressor of FIG. 1 at a maximum flow rate.
Figure 5:
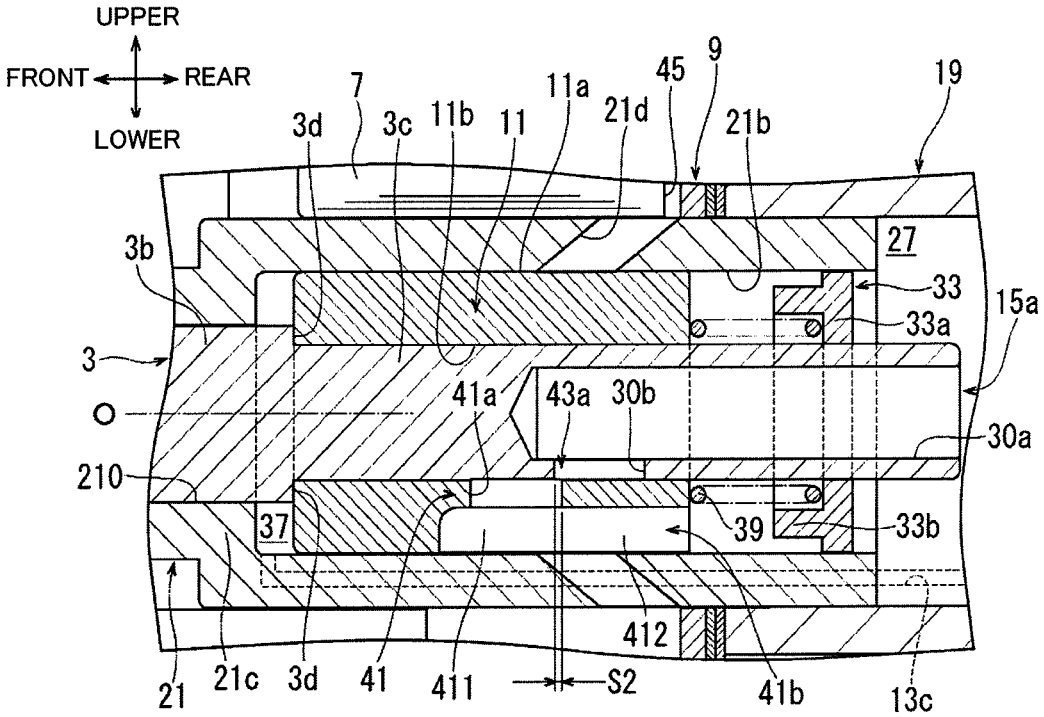
FIG. 5 is a partially enlarged longitudinal sectional view showing the piston compressor and its surroundings of FIG. 1 at a minimum flow rate.

The rotating body 11 is splined to the second diameter portion 3*c* on the inner circumferential surface 11*b*. That is, the rotating body 11 is provided on the outer circumferential surface of the drive shaft 3. The rotating body 11 is rotatable integrally with the drive shaft 3 in the second axial hole 21*b*. As shown in FIGS. 4 and 5, the rotating body 11 is movable in the direction of the axis O in the second axial hole 21*b* with respect to the drive shaft 3, or in the front-rear direction within the second axial hole 21*b* based on the differential pressure between suction pressure and control pressure. The suction pressure and the control pressure will be described later.

As shown in FIGS. 3 and 4, when the rotating body 11 moves to a most rearward position in the direction of the axis O in the second axial hole 21*b*, the rotating body 11 is brought into contact with the cylindrical portion 33*b* of the support part 33. As shown in FIG. 5, when the rotating body 11 moves at a most forward position in the direction of the axis O in the second axial hole 21*b*, the rotating body 11 is brought into contact with the stepped portion 3*d* of the drive shaft 3. Thus, the cylindrical portion 33*b* serves as a first regulating portion that regulates the amount of movement of the rotating body 11 in the rearward direction. The stepped portion 3*d* serves as a second regulating portion that regulates the amount of movement of the rotating body 11 in the forward direction.

A coil spring 39 is provided between the rotating body 11 and the support part 33. As shown in FIG. 3, the rear end of the coil spring 39 is accommodated in the cylindrical portion 33*b* of the support part 33. The coil spring 39 urges the rotating body 11 toward the front of the second axial hole 21*b*.

The rotating body 11 has a second communication passage 41. The second communication passage 41 has a first radial passage 41*a* and a main body passage 41*b*. The first radial passage 41*a* opens to the inner circumferential surface 11*b* of the rotating body 11 and extends in the radial direction of the rotating body 11. The first radial passage 41*a* communicates with the second radial passage 30*b* when the rotating body 11 is inserted through the second diameter portion 3*c*. The first radial passage 41*a* is formed to have substantially the same diameter as the second radial passage 30*b*.

The main body passage 41*b* is recessed on the outer circumferential surface 11*a* and communicates with the first radial passage 41*a*. Specifically, as shown in FIGS. 1 and 2, the main body passage 41*b* is formed so as to extend from the approximate center of the rear end of the rotating body 11 to the rear end of the rotating body 11 on the outer circumferential surface 11*a* in the front-back direction. The main body passage 41*b* gradually increases in the circumferential direction of the outer circumferential surface 11*a* from the front end of the rotating body 11 toward the rear end of the rotating body 11. That is, a first portion 411 is formed small in the circumferential direction of the outer circumferential surface 11*a* and is located on the front end side of the main body passage 41*b*. A second portion 412 is formed large in the circumferential direction of the outer circumferential surface 11*a* and is located on the rear end side of the main body passage 41*b*. The shape of the main body passage 41*b* may be modified. In FIGS. 1 and 2, the rotating body 11 is displaced from a position of the rotating body 11 shown in FIGS. 3 to 5 with respect to the axis O, for explanation. As shown in FIGS. 3 to 5, the shape of the main body passage 41*b* is simplified for ease of explanation. The shape of the main body passage 41*b* is simplified in FIGS. 8 to 19 described later.

As shown in FIGS. 3 to 5, the main body passage 41*b* of the second communication passage 41 communicates with each first communication passages 21*d* intermittently by the rotation of the rotating body 11 rotated by the drive shaft 3 in the second axial hole 21*b*. The main body passage 41*b* changes the communication angle around the axis O, at which the main body passage 41*b* communicates with each first communication passage 21 per one rotation of the drive shaft 3 depending on a position of the rotating body 11 in the second axial hole 21*b*, i.e., a position of the rotating body 11 with respect to the drive shaft 3 in the direction of the axis O of the drive shaft 3. Hereinafter, the communication angle around the axis O, at which the main body passage 41*b* communicates with each first communication passage 21 per one rotation of the drive shaft 3 is merely referred to as a communication angle.

As shown in FIG. 3, the control valve 13 is provided in the rear housing 19. The rear housing 19 has a detection passage 13*a* and a first supply passage 13*b*. The rear housing 19 cooperates with the cylinder block 21 to have a second supply passage 13*c*. The control valve 13 is connected to the suction chamber 27 through a detection passage 13*a*. The control valve 13 is connected to the discharge chamber 29 through the first supply passage 13*b*. The control valve 13 is connected to the control pressure chamber 37 through the second supply passage 13*c*. The refrigerant gas in the discharge chamber 29 is partly introduced into the control pressure chamber 37 through the first supply passage 13*b*, the second supply passage 13*c*, and the control valve 13. The control pressure chamber 37 is connected to the suction chamber 27 through a bleed passage (not shown) to introduce the refrigerant gas in the control pressure chamber 37 into the suction chamber 27 though the bleed passage. The control valve 13 adjusts its opening degree by monitoring and detecting the suction pressure, which is the pressure of refrigerant gas in the suction chamber 27, with the detection passage 13*a*. Consequently, the control valve 13 controls the flow rate of the refrigerant gas introduced from the discharge chamber 29 into the control pressure chamber 37. More specifically, the control valve 13 increases its valve opening degree to increase the flow rate of the refrigerant gas introduced from the discharge chamber 29 into the control pressure chamber 37 through the first supply passage 13*b* and the second supply passage 13*c*, and decreases its valve opening degree to decrease the flow rate of the refrigerant gas introduced from the discharge chamber 29 into the control pressure chamber 37 through the first supply passage 13*b* and the second supply passage 13*c*. The control valve 13 changes the flow rate of the refrigerant gas introduced from the discharge chamber 29 into the control pressure chamber 37 against the flow rate of the refrigerant gas introduced from the control pressure chamber 37 into the suction chamber 27 to control the control pressure, which is a pressure of refrigerant gas in the control pressure chamber 37. The control pressure chamber 37 may be connected to the swash plate chamber 31 through the bleed passage.

The suction unit 15*a* is constituted by the first communication passage 21*d*, the second communication passage 41, the axial passage 30*a*, and the second radial passage 30*b*. The suction unit 15*a* sucks refrigerant gas in the suction chamber 27 into each of the compression chambers 45. Specifically, refrigerant gas in the suction chamber 27 flows from the axial passage 30*a* into the second radial passage 30*b* and reaches the first radial passage 41*a* of the second communication passage 41. The refrigerant gas that reaches the first radial passage 41*a* flows from the first radial passage 41*a* into the main body passage 41*b* and flows from the main body passage 41*b* through the first communication passage 21*d* to be sucked into each compression chamber 45.

The suction throttle 43*a* is constituted by the first radial passage 41*a* and the second radial passage 30*b*. The movement of the rotating body 11 in the direction of the axis O in the second axial hole 21*b* changes the communicating area of the first radial passage 41*a* and the second radial passage 30*b*. As a result, the suction throttle 43*a* can change the flow rate of refrigerant gas into each compression chamber 45, or the flow rate of refrigerant gas sucked into each compression chamber 45, based on the movement of the rotating body 11 in the direction of the axis O.

In the compressor configured as described above, the drive shaft 3 rotates and then the fixed swash plate 5 rotates in the swash plate chamber 31. As a result, each piston 7 reciprocates in the cylinder bore 21*a* between the top dead center and the bottom dead center, so that in the compression chamber 45, an intake stroke for sucking refrigerant gas from the suction chamber 27, a compression stroke for compressing sucked refrigerant gas, and a discharge stroke for discharging compressed refrigerant gas are repeatedly performed. In the discharge stroke, the valve forming plate 9 discharges refrigerant gas in the compression chamber 45 into the discharge chamber 29 therethrough. Then, the refrigerant gas in the discharge chamber 29 is discharged to a condenser via the discharge port 29*a*.

In the compressor according to the present embodiment, when the rotating body 11 moves in the direction of the axis O in the second axial hole 21*b* during the intake stroke, the flow rate of refrigerant gas discharged from each compression chamber 45 into the discharge chamber 29 per one rotation of the drive shaft 3 can be changed.

Specifically, to increase the flow rate of the refrigerant gas discharged from each compression chamber 45 into the discharge chamber 29, the control valve 13 increases its valve opening degree to increase the flow rate of the refrigerant gas introduced from the discharge chamber 29 into the control pressure chamber 37, thereby increasing the control pressure in the control pressure chamber 37. This increases the variable differential pressure that is the differential pressure between the control pressure and the suction pressure.

Thus, the rotating body 11 starts to move rearward in the direction of the axis O from the position shown in FIG. 2 in the second axial hole 21*b* against the urging force of the coil spring 39. As a result, the main body passage 41*b* relatively moves rearward relative to each of the first communication passages 21*d*. As a result, in the portion formed small in the circumferential direction of the outer circumferential surface 11*a*, the main body passage 41*b* comes to communicate with each of the first communication passages 21*d*. Thus, in the compressor according to the present embodiment, the communication angle gradually decreases. As the rotating body 11 moves, the first radial passage 41*a* starts to relatively move rearward relative to the second radial passage 30*b*, so that the communicating area between the first radial passage 41*a* and the second radial passage 30*b* gradually increases. As a result, the suction throttle 43*a* gradually increases the flow rate of refrigerant gas into each compression chamber 45.

When the variable differential pressure becomes maximum, as shown in FIGS. 3 and 4, the rotating body 11 moves to the most rearward position in the second axial hole 21*b* and is in contact with the cylindrical portion 33*b*. Then, in the main body passage 41*b*, the first portion 411 communicates with each of the first communication passages 21*d*. Thus, in the compressor according to the present embodiment, the communication angle becomes minimum.

Therefore, when the rotating body 11 rotates, the main body passage 41*b* of the second communication passage 41 communicates with each of the first communication passages 21*d* only while each piston 7 moves from the top dead center to the bottom dead center in the compression chamber 45.

When the variable differential pressure becomes maximum, as shown in FIG. 4, the first radial passage 41*a* relatively moves rearward relative to the second radial passage 30*b*, so that the first radial passage 41*a* communicates with the second radial passage 30*b* over the whole area thereof. The communication area between the first radial passage 41*a* and the second radial passage 30*b* becomes the area S1. The suction throttle 43*a* maximizes the flow rate of refrigerant gas flowing into each compression chamber 45.

Thus, when each piston 7 moves from the top dead center to the bottom dead center, the flow rate of refrigerant gas sucked into the compression chamber becomes maximum.

In the compressor according to the present embodiment, when each compression chamber 45 is in the compression stroke, the flow rate of refrigerant gas compressed in the compression chamber 45 becomes maximum, so that when the compression chamber 45 is in the discharge stroke, the flow rate of the refrigerant gas discharged from the compression chamber 45 into the discharge chamber 29 becomes maximum.

On the other hand, to decrease the flow rate of the refrigerant gas discharged from each compression chamber 45 into the discharge chamber 29, the control valve 13 decreases its valve opening degree to decrease the flow rate of the refrigerant gas introduced from the discharge chamber 29 into the control pressure chamber 37, thereby decreasing the control pressure in the control pressure chamber 37. This decreases the variable differential pressure.

Then, the rotating body 11 moves forward from the state shown in FIG. 3 in the forward direction of the axis O in the second axial hole 21*b* due to the urging force of the coil spring 39. As a result, the main body passage 41*b* relatively moves forward relative to each of the first communication passages 21*d*, and is in a state of communicating with each of the first communication passages 21*d* at a portion formed large in the circumferential direction of the outer circumferential surface 11*a*. Therefore, the communication angle gradually increases.

Thus, as the rotating body 11 rotates, the main body passage 41*b* of the second communication passage 41 communicates with each of the first communication passages 21*d* not only while each piston 7 moves from the top dead center to the bottom dead center in each compression chamber 45, but also while each piston 7 moves from the bottom dead center to the top dead center by a certain degree. As a result, while each piston 7 moves from the top dead center to the bottom dead center, part of refrigerant gas sucked into each compression chamber 45 passes through the first communication passage 21*d* and the main body passage 41*b* and is discharged to the upstream side of the compression chamber 45, or to the outside of the compression chamber 45.

As the variable differential pressure decreases and the rotating body 11 moves forward, the first radial passage 41*a* relatively moves forward relative to the second radial passage 30*b*. Then, the communicating area between the first radial passage 41*a* and the second radial passage 30*b* gradually decreases. As a result, the suction throttle 43*a* decreases the flow rate of refrigerant gas into each compression chamber 45. While each piston 7 moves from the top dead center to the bottom dead center, the flow rate of refrigerant gas sucked into each compression chamber 45 decreases. Thus, in the compressor according to the present embodiment, when the compression chamber 45 is in the compression stroke, the flow rate of refrigerant compressed in each compression chamber 45 decreases, so that when the compression chamber 45 is in the discharge stroke, the flow rate of refrigerant gas discharged from the compression chamber 45 into the discharge chamber 29 decreases.

When the variable differential pressure becomes minimum, as shown in FIG. 5, the rotating body 11 moves at the most forward position in the second axial hole 21*b* and comes into contact with the stepped portion 3*d*. As a result, the second portion 412 of the main body passage 41*b* communicates with the respective first communication passages 21*d* and the communication angle becomes maximum. Since the variable differential pressure becomes minimum, the first radial passage 41*a* relatively moves forward relative to the second radial passage 30*b*, so that the first radial passage 41*a* communicates only with a small part of the second radial passage 30*b*. As a result, the communicating area between the first radial passage 41*a* and the second radial passage 30*b* becomes the minimum area S2 and the flow rate of refrigerant gas flowing from the second radial passage 30*b* into the first radial passage 41*a* becomes minimum.

Thus, when the communication angle becomes maximum, the main body passage 41*b* comes to communicate with the respective first communication passages 21*d* until the respective pistons 7 come closer to the top dead center. Then, a large amount of refrigerant gas is discharged to the outside of the compression chambers 45 through each of the first communication passages 21*d* and main body passage 41*b*. Since the communicating area between the first radial passage 41*a* and the second radial passage 30*b* becomes minimum area S2, the suction throttle 43*a* minimizes the flow rate of refrigerant gas to each compression chamber 45. While each piston 7 moves from the top dead center to the bottom dead center, the flow rate of refrigerant gas sucked into the compression chamber 45 becomes minimum. Thus, in the compressor according to the present embodiment, the flow rate of refrigerant gas compressed in each compression chamber 45 becomes minimum when the compression chamber 45 is in the compression stroke, so that when the compression chamber 45 is in the discharge stroke, the flow rate of refrigerant gas discharged from the compression chamber 45 into the discharge chamber 29 becomes minimum.

Thus, in the compressor according to the present embodiment, the flow rate of refrigerant gas discharged to the outside of each compression chamber 45 through the first communication passage 21*d* and the main body passage 41*b* and the flow rate of refrigerant sucked into each compression chamber 45 through the suction unit 15*a* can change the flow rate of refrigerant gas discharged from the compression chamber 45 into the discharge chamber 29. As a result, the compressor according to the present embodiment can perform excellent controllability.

The following will describe the function of the compressor according to the present embodiment in comparison with a compressor of a comparative example.

In the compressor according to the comparative example not shown in the drawing, the drive shaft 3 does not have the axial passage 30*a* and the second radial passage 30*b*. The second communication passage 41 is constituted only by the main body passage 41*b*. Accordingly, in the compressor of the comparative example, the suction unit 15*a* does not have the suction throttle 43*a*. The other configuration of the compressor according to the comparative example is the same as that of the compressor according to the first embodiment.

In the compressor according to the comparative example, refrigerant gas in the suction chamber 27 is sucked through the main body passage 41*b* and each of the first communication passages 21*d* into the compression chamber 45. Then, since the compressor according to the comparative example does not have the suction throttle 43*a*, the compressor is configured to change only the flow rate of refrigerant gas discharged to the outside of each compression chamber 45 so that the flow rate of refrigerant gas in the compression chamber 45 changes.

Figure 6:
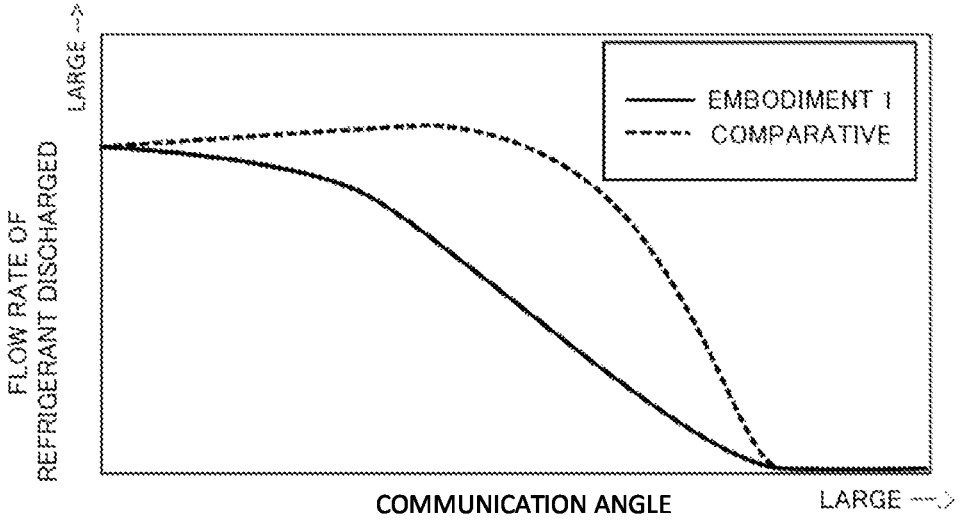
FIG. 6 is a graph showing the relationship between the change of communication angle and the change of discharge flow rate in the piston compressor of FIG. 1 at a high-speed rotation.
Figure 7:
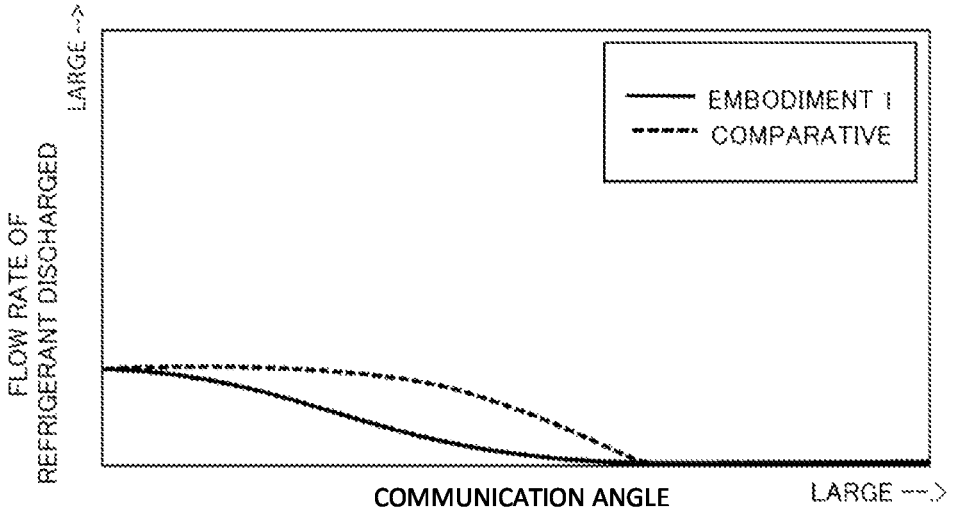
FIG. 7 is a graph showing the relationship between the change of communication angle and the change of discharge flow rate in the piston compressor of FIG. 1 at a low-speed rotation.

As shown in FIGS. 6 and 7, in the compressor according to the comparative example, if the communication angle changes from a small state to a large state, the flow rate of refrigerant discharged from each compression chamber into the discharge chamber 29 is difficult to decrease. For the reason, the controllability of the compressor according to the comparative example cannot be increased. In particular, as shown in FIG. 6, in an operating state in which the drive shaft 3 rotates at a high speed and the fixed swash plate 5 rotates at a high speed, the main body passage 41*b* becomes disconnected from each of the first communication passages 21*d* by the rotation of the rotating body 11 before refrigerant gas sucked into each compression chamber 45 is sufficiently discharged to the outside of the compression chamber 45 through the main body passage 41*b* and the first communication passage 21*d*. Therefore, in the compressor according to the comparative example, the flow rate of refrigerant gas present in each compression chamber 45 is difficult to decrease. Since the refrigerant gas is compressed, in the compressor according to the comparative example, the flow rate of refrigerant gas discharged from each compression chamber 45 into the discharge chamber 29 is remarkably difficult to decrease when the communication angle changes from a small state to a large state.

On the other hand, in the compressor according to the first embodiment, the suction throttle 43*a* decreases the flow rate of refrigerant gas into each compression chamber 45 when the communication angle becomes large based on the control pressure. Thus, in the compressor according to the first embodiment including the case where the communication angle is the maximum based on the control pressure, when the communication angle is large, the flow rate of refrigerant gas sucked into each compression chamber 45 decreases.

As a result, in the compressor according to the first embodiment as compared to the compressor according to the comparative example, as shown in FIG. 6, not only in the case where the fixed swash plate 5 rotates at a high speed, but also when the fixed swash plate 5 rotates at a low speed, the flow rate of refrigerant gas discharged from each compression chamber 45 into the discharge chamber 29 suitably decreases when the communication angle changes from the small state to the large state. Thus, in the compressor according to the first embodiment, the flow rate of refrigerant gas discharged from each compression chamber 45 into the discharge chamber 29 can suitably decrease as the communication angle increases. In the compressor according to the first embodiment, when the communication angle is small, including the case where the communication angle is the minimum, the flow rate of refrigerant gas discharged from each compression chamber 45 after refrigerant gas is sucked into the compression chamber 45 decreases while the flow rate of refrigerant gas sucked into each compression chamber 45 increases. Thus, the flow rate of refrigerant gas discharged from each compression chamber 45 into the discharge chamber 29 can suitably increase.

Accordingly, the compressor according to the first embodiment is excellent in controllability.

In particular, in the compressor according to the first embodiment, the communication area between the first radial passage 41*a* and the second radial passage 30*b* changes in the suction throttle 43*a* based on the movement of the rotating body 11 in the direction of the axis O. Since the communication angle increases, the communication area between the first radial passage 41*a* and the second radial passage 30*b* decreases, so that the flow area of refrigerant gas into each compression chamber 45 decreases. Accordingly, in the compressor according to the first embodiment, the suction throttle 43*a* can suitably adjust the flow rate of refrigerant gas into each compression chamber 45 in accordance with the position of the rotating body 11 in the second axial hole 21*b*. The suction throttle 43*a* decreases the flow rate of refrigerant gas into each compression chamber 45 when the communication angle becomes large based on the movement of the rotating body 11 in the direction of the axis O.

Further, this compressor performs an inlet-side control such that the control valve 13 changes a flow rate of the refrigerant gas introduced from the discharge chamber 29 into the control pressure chamber 37 through the first supply passage 13*b* and the second supply passage 13*c*. This enables a pressure in the control pressure chamber 37 to become higher quickly, thereby increasing the flow rate of the refrigerant gas discharged from each compression chamber 45 into the discharge chamber 29 quickly.

Second Embodiment

Figure 8:
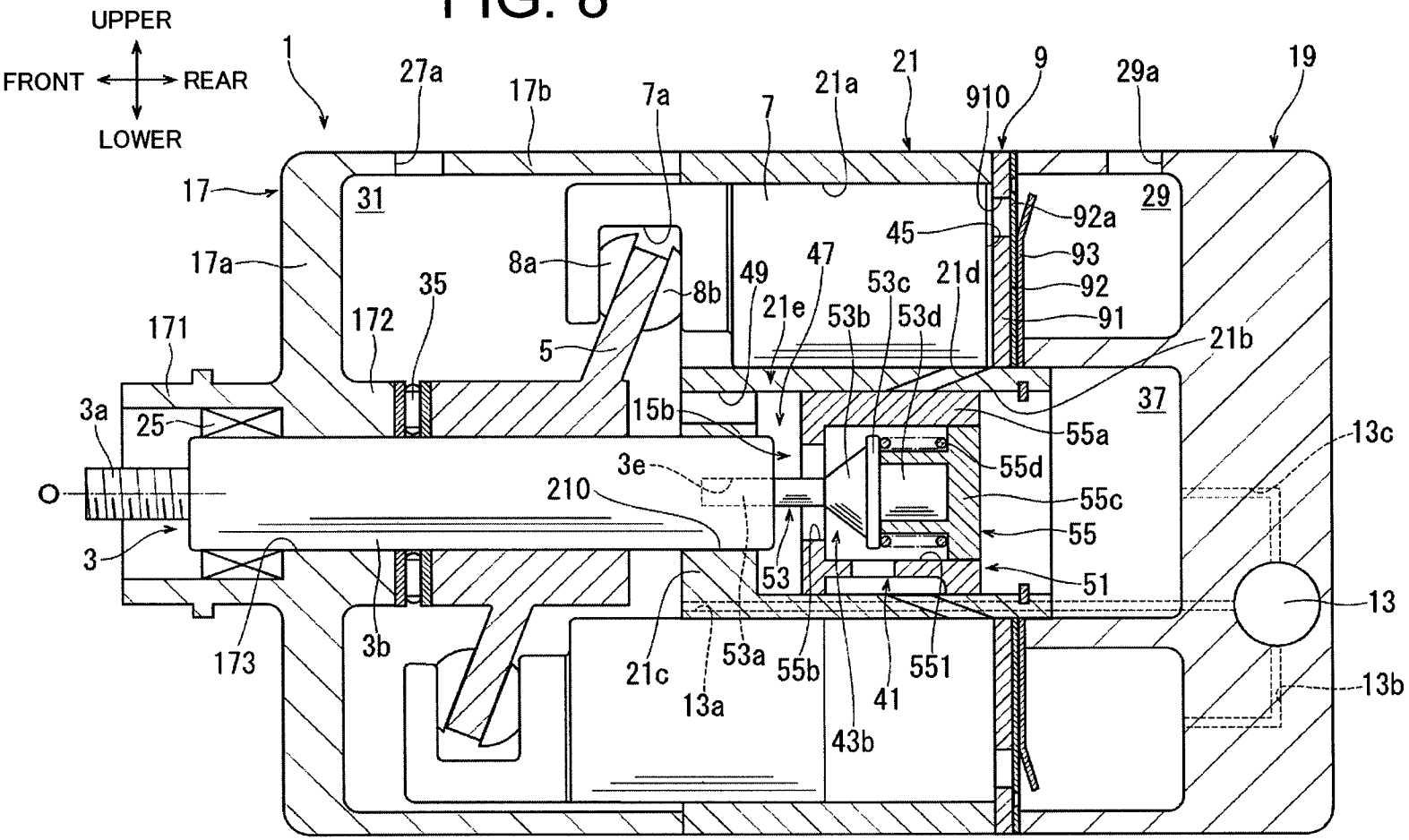
FIG. 8 is a longitudinal sectional view showing a piston compressor at a maximum flow rate, according to a second embodiment of the present disclosure.

As shown in FIG. 8, in the compressor according to a second embodiment, the suction port 27*a* is formed in the circumferential wall 17*b* of the front housing 17. In the compressor according to the second embodiment, low pressure refrigerant gas passing through the evaporator is sucked into the swash plate chamber 31 through the suction port 27*a*. That is, the swash plate chamber 31 also serves as a suction chamber. Thus, the suction pressure is maintained in the swash plate chamber 31. The control valve 13 is connected to the swash plate chamber 31 through the detection passage 13*a*. The control pressure chamber 37 is formed on the center side of the rear housing 19. As a result, the rear end of the second axial hole 21*b* communicates with the control pressure chamber 37 and control pressure applies to the rear end of the second axial hole 21*b* as well as the control pressure chamber 37. In this compressor, the control pressure chamber 37 is connected to the swash plate chamber 31 through the bleed passage (not shown).

The cylinder block 21 has a suction passage 21*e* formed in the second axial hole 21*b*. The suction passage 21*e* is constituted by a suction space 47 formed in the second axial hole 21*b* and a through hole 49 formed in the support wall 21*c*. The through hole 49 passes through the support wall 21*c* in the direction of the axis O so that the swash plate chamber 31 communicates with the suction space 47. The through hole 49 and the suction space 47 are applied by suction pressure as well as the swash plate chamber 31. The suction space 47 will be described later.

Figure 9:
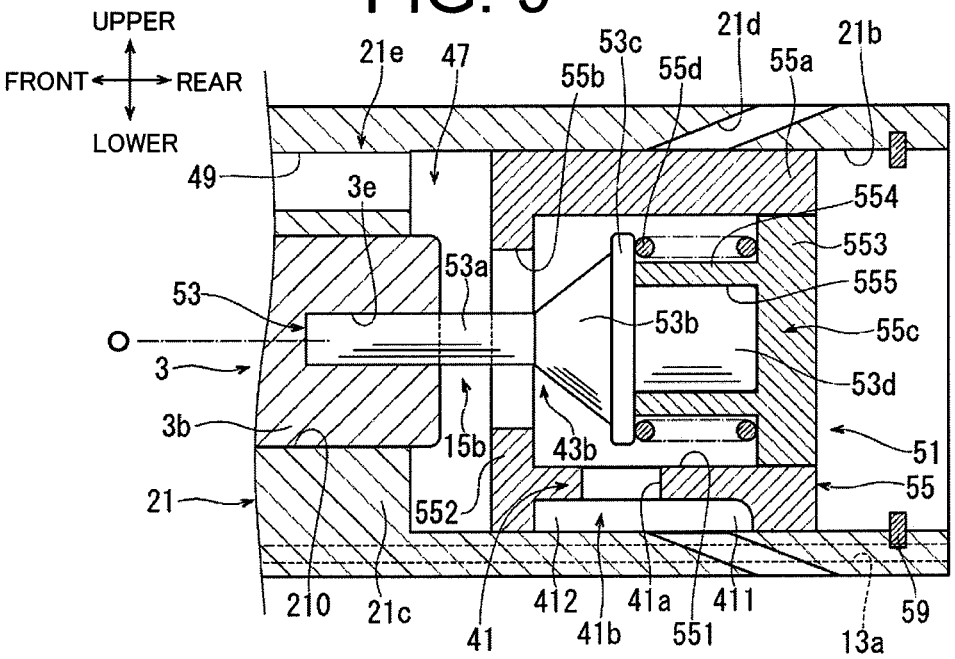
FIG. 9 is a partially enlarged longitudinal sectional view showing a suction throttle and its surroundings of the piston compressor of FIG. 8 at a maximum flow rate.
Figure 10:
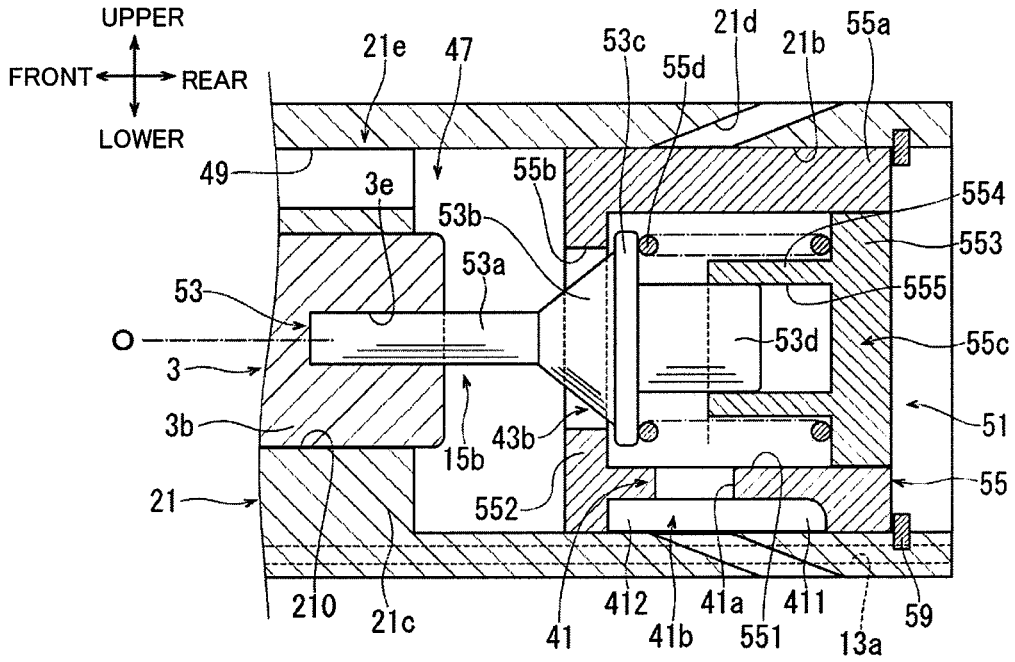
FIG. 10 is a partially enlarged longitudinal sectional view showing the suction throttle and its surroundings of the piston compressor of FIG. 8 at a minimum flow rate.

The drive shaft 3 includes a threaded portion 3*a* and a first diameter portion 3*b*. The length of the drive shaft 3 in the direction of the axis O is shorter than that of the compressor according to the first embodiment. As shown in FIGS. 9 and 10, the first diameter portion 3*b* has a recess 3*e* extending forward from the rear surface thereof in the direction of the axis O.

In the compressor according to the second embodiment, a rotating body 51 is provided. The rotating body 51 has a first valve body 53 and a second valve body 55. The first valve body 53 and the second valve body 55 are disposed in the second axial hole 21*b*.

The first valve body 53 has a shaft portion 53*a*, a tapered portion 53*b*, a spring seat 53*c*, and a connecting portion 53*d*. The shaft portion 53*a* extends in the direction of the axis O. The front side of the shaft portion 53*a* is press-fitted into the recess 3*e*. Thus, the first valve body 53 is fixed to the drive shaft 3 and is integrally rotatable with the drive shaft 3 in the second axial hole 21*b*. The tapered portion 53*b* is connected to the rear end of the shaft portion 53*a*. The tapered portion 53*b* has a conical shape that gradually increases in diameter as the tapered portion 53*b* extends rearward in the direction of the axis O. The spring seat 53*c* is connected to the rear end of the tapered portion 53*b*. The diameter of the spring seat

53*c* is larger than that of the rear end of the tapered portion 53*b*, which is the portion having the maximum diameter in the tapered portion 53*b*. The connecting portion 53*d* is formed to be smaller in diameter than the spring seat 53*c* and is connected to the spring seat 53*c*. The connecting portion 53*d* extends from the spring seat 53*c* rearward in the direction of the axis O.

The second valve body 55 is disposed in the second axial hole 21*b*, so that the second valve body 55 partitions the suction space 47 from the control pressure chamber 37 in the second axial hole 21*b*. Thus, the space between the second valve body 55 and the support wall 21*c* serves as the suction space 47 in the second axial hole 21*b*.

The second valve body 55 has a valve main body 55*a*, a valve hole 55*b*, a support part 55*c*, and a coil spring 55*d*. The valve main body 55*a* is formed in a cylindrical shape that has substantially the same diameter as the second axial hole 21*b*. The valve main body 55*a* has an annular passage 551. The valve main body 55*a* has the second communication passage 41 constituted by the first radial passage 41*a* and the main body passage 41*b*. In the compressor according to the second embodiment, the main body passage 41*b* is recessed on the outer circumferential surface of the valve main body 55*a* in a state in which the direction of the main body passage 41*b* is reversed from that in the compressor according to the first embodiment in the front-rear direction. Thus, in the compressor according to the second embodiment, the first portion 411 is located on the rear end side of the main body passage 41*b* and the second portion 412 is located on the front end side of the main body passage 41*b*. The first radial passage 41*a* communicates with the annular passage 551. As a result, the annular passage 551 communicates with the second communication passage 41.

The valve hole 55*b* is located in front of the valve main body 55*a* and formed integrally with the valve main body 55*a*. The periphery of the valve hole 55*b*, or the front surface of the valve main body 55*a* is a valve seat 552. The valve hole 55*b* extends in the direction of the axis O and communicates with the annular passage 551. As a result, the annular passage 551 communicates with the suction space 47 through the valve hole 55*b*. The shaft portion 53*a* and the tapered portion 53*b* of the first valve body 53 are inserted through the valve hole 55*b*. The valve hole 55*b* is formed slightly larger in diameter than the tapered portion 53*b*.

The support part 55*c* has a flange portion 553 and a connected portion 554. The flange portion 553 is press-fitted into the valve main body 55*a*. As a result, the support part 55*c* is fixed to the valve main body 55*a* in a state that the support part 55*c* is located behind the first valve body 53 in the annular passage 551. The connected portion 554 is integrally formed with the flange portion 553 and extends from the flange portion 553 toward the first valve body 53. The connected portion 554 has a connecting hole 555. The connecting portion 53*d* of the first valve body 53 is inserted into the connecting hole 555.

The connecting portion 53*d* is splined to the connected portion 554 in the connecting hole 555. As a result, the rotation of the drive shaft 3 and the first valve body 53 is transmitted to the valve main body 55*a*. Thus, in the second axial hole 21*b*, the second valve body 55 including the valve main body 55*a* is rotatable integrally with the drive shaft 3 and the first valve body 53. In the second valve body 55, the connected portion 554 slides relative to the connecting portion 53*d* in the direction of the axis O due to the differential pressure between the suction pressure and the control pressure. Thus, the second valve body 55 is movable in the second axial hole 21*b* with respect to the drive shaft 3 and the first valve body 53 in the direction of the axis O based on the control pressure.

The coil spring 55*d* is provided between the spring seat 53*c* and the flange portion 553. The coil spring 55*d* urges the second valve body 55 toward the rear of the second axial hole 21*b*.

A circlip 59 is provided in the second axial hole 21*b*. The circlip 59 is located on the rear side of the second axial hole 21*b* and comes in contact with the second valve body 55 when the second valve body 55 moves in the second axial hole 21*b* furthest rearward in the direction of the axis O. As a result, the circlip 59 regulates the amount of movement of the second valve body 55 in the rearward direction. When the second valve body 55 moves in the second axial hole 21*b* furthest forward in the direction of the axis O, the connected portion 554 comes into contact with the spring seat 53*c* of the first valve body 53. As a result, the connected portion 554 and the spring seat 53*c* regulate the forward movement amount of the second valve body 55.

In the compressor according to the present embodiment, the suction unit 15*b* is constituted by the first communication passage 21*d*, the second communication passage 41, the suction passage 21*e*, the valve hole 55*b*, and the annular passage 551. In the compressor according to the present embodiment, refrigerant gas sucked into the swash plate chamber 31 reaches the first radial passage 41*a* through the suction passage 21*e*, the valve hole 55*b*, and the annular passage 551. The refrigerant gas that reaches the first radial passage 41*a* flows from the main body passage 41*b* through the first communication passage 21*d* and is sucked into each compression chamber 45.

The compressor according to the present embodiment, has the suction throttle 43*b*. The suction throttle 43*b* is constituted by the shaft portion 53*a*, the tapered portion 53*b* of the first valve body 53, and the valve hole 55*b*. Other configurations of the compressor are the same as those of the compressor according to the first embodiment, and the same components are denoted by the same reference numerals, and a detailed description thereof will be omitted.

In the compressor according to the present embodiment, the control valve 13 increases the control pressure of the control pressure chamber 37 to increase the variable differential pressure so that the second valve body 55 resists the urging force of the coil spring 55*d* and starts to move in the second axial hole 21*b* from the state shown in FIG. 1 forward in the direction of the axis O. Then, the tapered portion 53*b* starts to move rearward relative to the annular passage 551. As a result, in the suction throttle 43*b*, the opening degree of the valve hole 55*b* gradually increases. Thus, the flow rate of refrigerant gas flowing through the valve hole 55*b* gradually increases. As a result, the suction throttle 43*b* gradually increases the flow rate of refrigerant gas into each compression chamber 45. As the second valve body 55 moves in the second axial hole 21*b* forward in the direction of the axis O, the communication angle gradually decreases. Thus, the flow rate of refrigerant gas discharged from each compression chamber 45 into the discharge chamber 29 gradually increases.

When the variable differential pressure becomes maximum, the tapered portion 53*b* moves further rearward relative to the valve hole 55*b*, so that as shown in FIG. 9, only the shaft portion 53*a* enters in the valve hole 55*b*. In the suction throttle 43*b*, the opening degree of the valve hole 55*b* becomes maximum, so that the flow rate of refrigerant gas flowing through the valve hole 55*b* becomes maximum. As a result, the suction throttle 43*b* maximizes the flow rate of refrigerant gas into each compression chamber 45. In the main body passage 41*b*, when the first portion 411 communicates with each of the first communication passages 21*d*, the communication angle with the first portion 411 becomes minimum. Thus, in the compressor according to the present embodiment, the flow rate of refrigerant gas discharged from each compression chamber 45 into the discharge chamber 29 becomes maximum.

On the other hand, the control valve 13 reduces the control pressure of the control pressure chamber 37 to reduce the variable differential pressure, so that the second valve body 55 moves in the second axial hole 21*b* rearward in the direction of the axis O due to the urging force of the coil spring 55*d*. Then, the tapered portion 53*b* relatively moves forward relative to the valve hole 55*b* and starts to enter the valve hole 55*b*. As a result, in the suction throttle 43*b*, the opening degree of the valve hole 55*b* gradually decreases. Thus, the suction throttle 43*b* gradually decreases the flow rate of refrigerant gas into each compression chamber 45. As the second valve body 55 moves rearward in the second axial hole 21*b* in the direction of the axis O, the communication angle gradually decreases. Thus, the flow rate of refrigerant gas discharged from each compression chamber 45 into the discharge chamber 29 gradually decreases.

When the variable differential pressure becomes minimum, the tapered portion 53*b* enters deeper into the valve hole 55*b*. As a result, in the suction throttle 43*b*, the opening degree of the valve hole 55*b* becomes minimum, so that refrigerant gas flows from the suction passage 21*e* into the annular passage 551 through a slight gap between the valve hole 55*b* and the tapered portion 53*b*. That is, the flow rate of refrigerant gas flowing through the valve hole 55*b* becomes minimum. As a result, the suction throttle 43*b* minimizes the flow rate of refrigerant gas into each compression chamber 45. The main body passage 41*b* communicates with the first communication passage 21*d* in the second portion 412, so that the communication angle becomes maximum. Thus, in the compressor according to the present embodiment, the flow rate of refrigerant gas discharged from each compression chamber 45 into the discharge chamber 29 becomes minimum.

Third Embodiment

Figure 11:
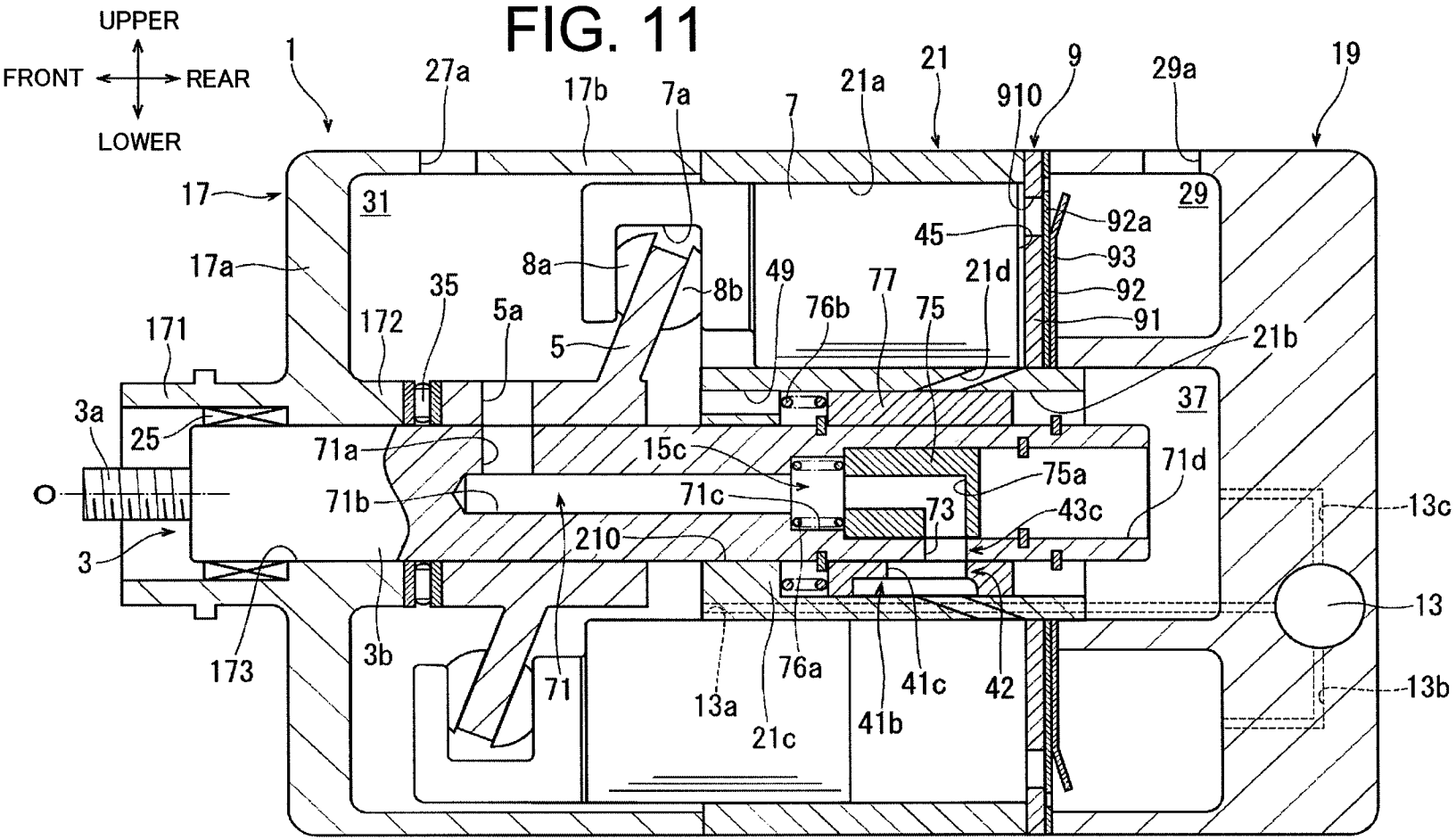
FIG. 11 is a longitudinal sectional view showing a piston compressor at a maximum flow rate, according to a third embodiment of the present disclosure.

As shown in FIG. 11, in the compressor according to the third embodiment, the suction port 27*a* is formed in the circumferential wall 17*b* of the front housing 17. Accordingly, as in the case of the compressor according to the second embodiment, since the swash plate chamber 31 also serves as the suction chamber in the compressor according to the third embodiment, the suction pressure is maintained in the swash plate chamber 31. The control valve 13 is connected to the swash plate chamber 31 through the detection passage 13*a*. The swash plate chamber 31 and the inside of the second axial hole 21*b* communicate with each other through the through hole 49 formed in the support wall 21*c*. On the other hand, the control pressure chamber 37 is formed on the center side of the rear housing 19. Accordingly, the second axial hole 21*b* also communicates with the control pressure chamber 37. The fixed swash plate 5 has the introduction passage 5*a* extending in the radial direction and opening into the swash plate chamber 31.

The drive shaft 3 is constituted by the threaded portion 3*a* and the first diameter portion 3*b*. The rear end of the first diameter portion 3*b* protrudes from the inside of the second axial hole 21*b* and extends into the control pressure chamber 37. The first diameter portion 3*b* has a supply passage 71 and a connecting passage 73. The supply passage 71 includes a first supply passage 71*a*, a second supply passage 71*b*, a third supply passage 71*c*, and a fourth supply passage 71*d*. The first supply passage 71*a* is located on the front side of the first diameter portion 3*b*. The first supply passage 71*a* extends in the radial direction and opens to the outer peripheral surface of the first diameter portion 3*b* and communicates with the introduction passage 5*a*. As a result, the supply passage 71 is connected to the swash plate chamber 31 through the introduction passage 5*a*.

Figure 12:
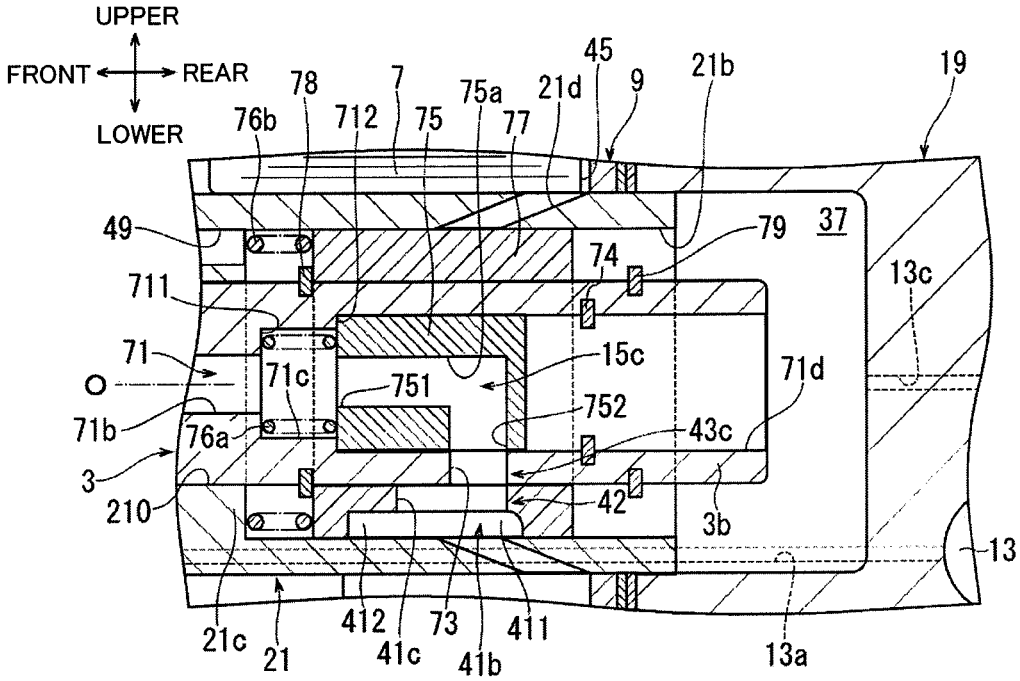
FIG. 12 is a partially enlarged longitudinal sectional view showing a suction throttle and its surroundings of the piston compressor of FIG. 11 at a maximum flow rate.
Figure 13:
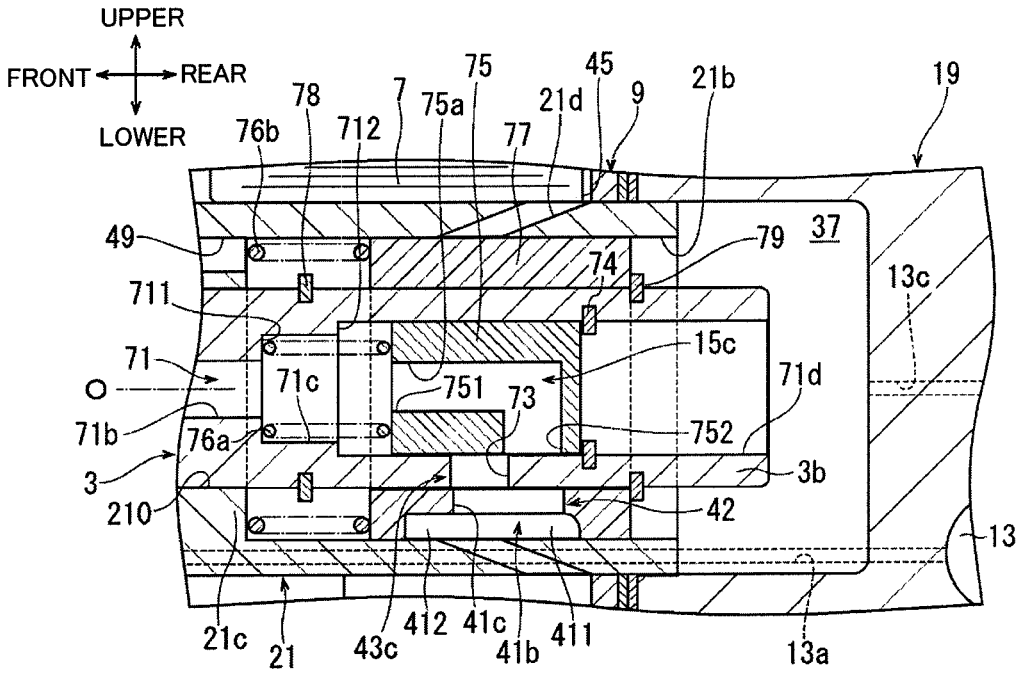
FIG. 13 is a partially enlarged longitudinal sectional view showing the suction throttle and its surroundings of the piston compressor of FIG. 11 at a minimum flow rate.

The second supply passage 71*b* communicates with the first supply passage 71*a* and extends rearward in the direction of the axis O in the first diameter portion 3*b*. As shown in FIGS. 12 and 13, the third supply passage 71*c* communicates with the second supply passage 71*b* and extends rearward in the direction of the axis O in the first diameter portion 3*b*. The third supply passage 71*c* is formed to have a larger diameter than the second supply passage 71*b* in the direction of the axis O. Thus, a first step portion 711 is formed between the second supply passage 71*b* and the third supply passage 71*c*. The fourth supply passage 71*d* communicates with the third supply passage 71*c*. The fourth supply passage 71*d* extends rearward in the direction of the axis O in the first diameter portion 3*b* and opens to the rear surface of the first diameter portion 3*b*. As a result, the supply passage 71 is also connected to the control pressure chamber 37. In addition, the fourth supply passage 71*d* is formed to have a diameter larger than that of the third supply passages 71*c*. As a result, a second step portion 712 is formed between the third supply passage 71*c* and the fourth supply passage 71*d*. The connecting passage 73 communicates with the fourth supply passage 71*d*. The connecting passage 73 extends in the radial direction and opens to the outer peripheral surface of the first diameter portion 3*b*.

A moving body 75 is provided in the fourth supply passage 71*d*. The moving body 75 is formed to have substantially the same diameter as the fourth supply passage 71*d* and splined to the fourth supply passage 71*d*. As a result, the moving body 75 can rotate integrally with the drive shaft 3. The moving body 75 is movable in the fourth supply passage 71*d* in the direction of the axis O. Since the moving body 75 is provided in the fourth supply passage 71*d*, suction pressure applies to the front face of the moving body 75 through the first to third supply passages 71*a* to 71*c*. Control pressure applies to the rear face of the moving body 75 through the fourth supply passage 71*d*. The moving body 75 is movable based on the control pressure in the direction of the axis O.

The moving body 75 has a through passage 75*a*. The through passage 75*a* has a substantially crank shape and extends in the direction of the axis O and in the radial direction. The through passage 75*a* has a first opening 751 that opens toward the second and third supply passages 71*b* and 71*c* and a second opening 752 that opens toward the connecting passage 73. As a result, the through passage 75*a* communicates with the swash plate chamber 31 through the first to third supply passages 71*a* to 71*c*, and communicates with the connecting passage 73.

A circlip 74 is provided in the fourth supply passage 71*d*. As shown in FIG. 13, the moving body 75 comes in contact with the circlip 74 when the moving body 75 moves in the fourth supply passage 71*d* furthest rearward in the direction of the axis O. As a result, the circlip 74 regulates the amount of movement of the moving body 75 in the rearward direction. On the other hand, as shown in FIG. 12, the moving body 75 comes in contact with the second step portion 712 when the moving body 75 moves in the fourth supply passage 71*d* furthest forward in the direction of the axis O. As a result, the second step portion 712 regulates the amount of movement of the moving body 75 in the forward direction.

In the third supply passage 71*c*, a coil spring 76*a* is provided between the first step portion 711 and the moving body 75. The coil spring 76*a* urges the moving body 75 toward the rear of the fourth supply passage 71*d*.

The compressor according to the present embodiment, includes a rotating body 77. The rotating body 77 is formed in a cylindrical shape having substantially the same diameter as the second axial hole 21*b* and is disposed in the second axial hole 21*b*. That is, the rotating body 77 is provided on the outer circumferential surface of the drive shaft 3. As a result, suction pressure applies to the front face of the rotating body 77 through the through hole 49. Control pressure applies to the rear face of the rotating body 77.

The rotating body 77 is splined to the first diameter portion 3*b* of the drive shaft 3. As a result, the rotating body 77 is integrally rotatable with the drive shaft 3 in the second axial hole 21*b*. The rotating body 77 is movable in the second axial hole 21*b* with respect to the drive shaft 3 in the direction of the axis O due to the differential pressure between the suction pressure and the control pressure.

Circlips 78 and 79 are provided on the first diameter portion 3*b*. The circlip 78 is provided on the front side of the second axial hole 21*b* in the first diameter portion 3*b* so that when the rotating body 77 moves to the most forward position in the second axial hole 21*b* in the direction of the axis O, the rotating body 77 comes in contact with the circlip 78. As a result, the circlip 78 regulates the amount of the forward movement of the rotating body 77. The circlip 79 is provided on the rear side in the second axial hole 21*b* in the first diameter portion 3*b* so that when the rotating body 77 moves to the most rearward position in the second axial hole 21*b* in the direction of the axis O, the rotating body 77 comes in contact with the circlip 79. As a result, the circlip 79 regulates the amount of the rearward movement of the rotating body 77.

In the second axial hole 21*b*, a coil spring 76*b* is provided between the rotating body 77 and the support wall 21*c*. The coil spring 76*b* urges the rotating body 77 toward the rear of the second axial hole 21*b*.

The rotating body 77 has the main body passage 41*b* and the third radial passage 41*c*. The main body passage 41*b* and the third radial passage 41*c* constitute the second communication passage 42. In the compressor according to the present embodiment, as in the case of the compressor according to the second embodiment, the main body passage 41*b* is recessed on the outer peripheral surface of the rotating body 77 in a state in which the direction of the main body passage 41*b* is reversed from that in the compressor according to the first embodiment in the front-rear direction. The third radial passage 41*c* extends radially and communicates with the main body passage 41*b* and the connecting passage 73. That is, the second communication passage 42 communicates with the connecting passage 73. The third radial passage 41*c* is formed longer in the direction of the axis O than the first radial passage 41*a* of the compressor according to the first embodiment. Thus, even when the rotating body 77 moves in the second axial hole 21*b* in the direction of the axis O, the communicating area between the third radial passage 41*c* and the connecting passage 73 is constant.

In the compressor according to the third embodiment, a suction unit 15*c* is constituted by each of the first communication passages 21*d*, the second communication passage 42, the supply passage 71, the connecting passage 73, and the through passage 75*a*. As a result, in the compressor according to the present embodiment, refrigerant gas sucked into the swash plate chamber 31 reaches the third radial passage 41*c* from the connecting passage 73 through the supply passage 71 and the through passage 75*a*. That is, the connecting passage 73 communicates with the second communication passage 42. The refrigerant gas that reaches the third radial passage 41*c* flows from the main body passage 41*b* through each of the first communication passages 21*d* and is sucked into each compression chamber 45.

The compressor according to the third embodiment includes the suction throttle 43*c*. The suction throttle 43*c* is constituted by the connecting passage 73 and the through passage 75*a*. In this compressor according to the third embodiment, as in the case of the compressor according to the second embodiment, the control pressure chamber 37 is connected to the swash plate chamber 31 through the bleed passage (not shown). The other configuration of the compressor according to the third embodiment is the same as that of the compressor according to the first embodiment.

In the compressor according to the third embodiment, the control valve 13 increases the control pressure of the control pressure chamber 37 to increase the variable differential pressure, so that the rotating body 77 starts to move in the second axial hole 21*b* from the state shown in FIG. 13 against the urging force of the coil spring 76*b* in the direction of the axis O. At the same time, the moving body 75 starts to move in the fourth supply passage 71*d* against the urging force of the coil spring 76*a* forward in the direction of the axis O. As a result, in the suction throttle 43*c*, the communicating area between the second opening 752 of the through passage 75*a* and the connecting passage 73 gradually increases. Then, the flow rate of refrigerant gas flowing from the through passage 75*a* into the connecting passage 73 gradually increases. Thus, the suction throttle 43*c* gradually increases the flow rate of refrigerant gas into each compression chamber 45. As the rotating body 77 moves forward, the communicating angle gradually decreases. Thus, the flow rate of refrigerant gas discharged from each compression chamber 45 into the discharge chamber 29 gradually increases.

When the variable differential pressure becomes maximum, as shown in FIG. 12, the moving body 75 is located at the most forward position in the fourth supply passage 71*d*. As a result, the communicating area between the second opening 752 and the connecting passage 73 becomes maximum in the suction throttle 43*c*, so that the flow rate of refrigerant gas flowing from the through passage 75*a* into the connecting passage 73 becomes maximum. Thus, the suction throttle 43*c* maximizes the flow rate of refrigerant gas to each compression chamber 45. In the case, the rotating body 77 is located at the most forward position in the second axial hole 21*b*, so that the communication angle becomes minimum. Thus, in the compressor according to the third embodiment, the flow rate of refrigerant gas discharged from each compression chamber 45 into the discharge chamber 29 becomes maximum.

On the other hand, the control valve 13 decreases the control pressure of the control pressure chamber 37 to reduce the variable differential pressure, so that the urging force of the coil spring 76*b* causes the rotating body 77 to start to move in the second axial hole 21*b* rearward in the direction of the axis O. At the same time, the moving body 75 starts to move in the fourth supply passage 71*d* rearward in the direction of the axis O due to the urging force of the coil spring 76*a*. As a result, the communicating area between the second opening 752 and the connecting passage 73 gradually decreases in the suction throttle 43*c*. Thus, the flow rate of refrigerant gas flowing from the through passage 75*a* into the connecting passage 73 gradually decreases. As a result, the suction throttle 43*c* decreases the flow rate of refrigerant gas to each compression chamber 45. As the rotating body 77 moves rearward, the communication angle gradually increases. Thus, the flow rate of refrigerant gas discharged from each compression chamber into the discharge chamber 29 decreases.

Then, when the variable differential pressure becomes minimum, as shown in FIG. 13, the moving body 75 is located at the furthest rear position in the fourth supply passage 71*d*. As a result, the communicating area between the second opening 752 and the connecting passage 73 becomes minimum in the suction throttle 43*c*, so that the flow rate of refrigerant gas flowing from the through passage 75*a* into the connecting passage 73 becomes minimum. Thus, the suction throttle 43*c* minimizes the flow rate of refrigerant gas to each compression chamber 45. In the case, the rotating body 77 is located at a most rearward position in the second axial hole 21*b*, so that the communication angle becomes maximum. Thus, in the compressor according to the third embodiment, the flow rate of refrigerant gas discharged from each compression chamber 45 into the discharge chamber 29 becomes minimum.

Fourth Embodiment

Figure 14:
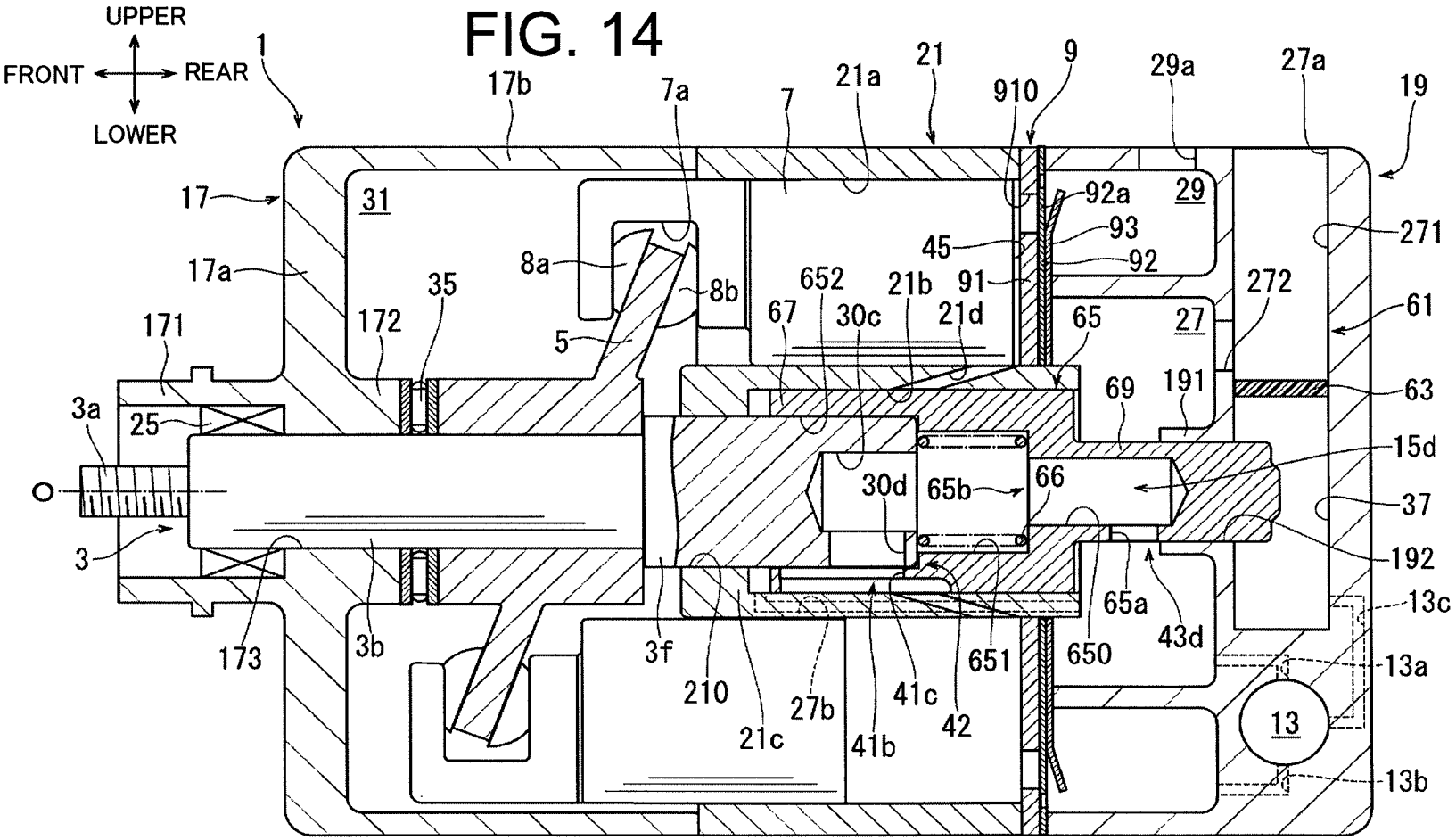
FIG. 14 is a longitudinal sectional view showing a piston compressor at a maximum flow rate, according to a fourth embodiment of the present disclosure.
Figure 15:
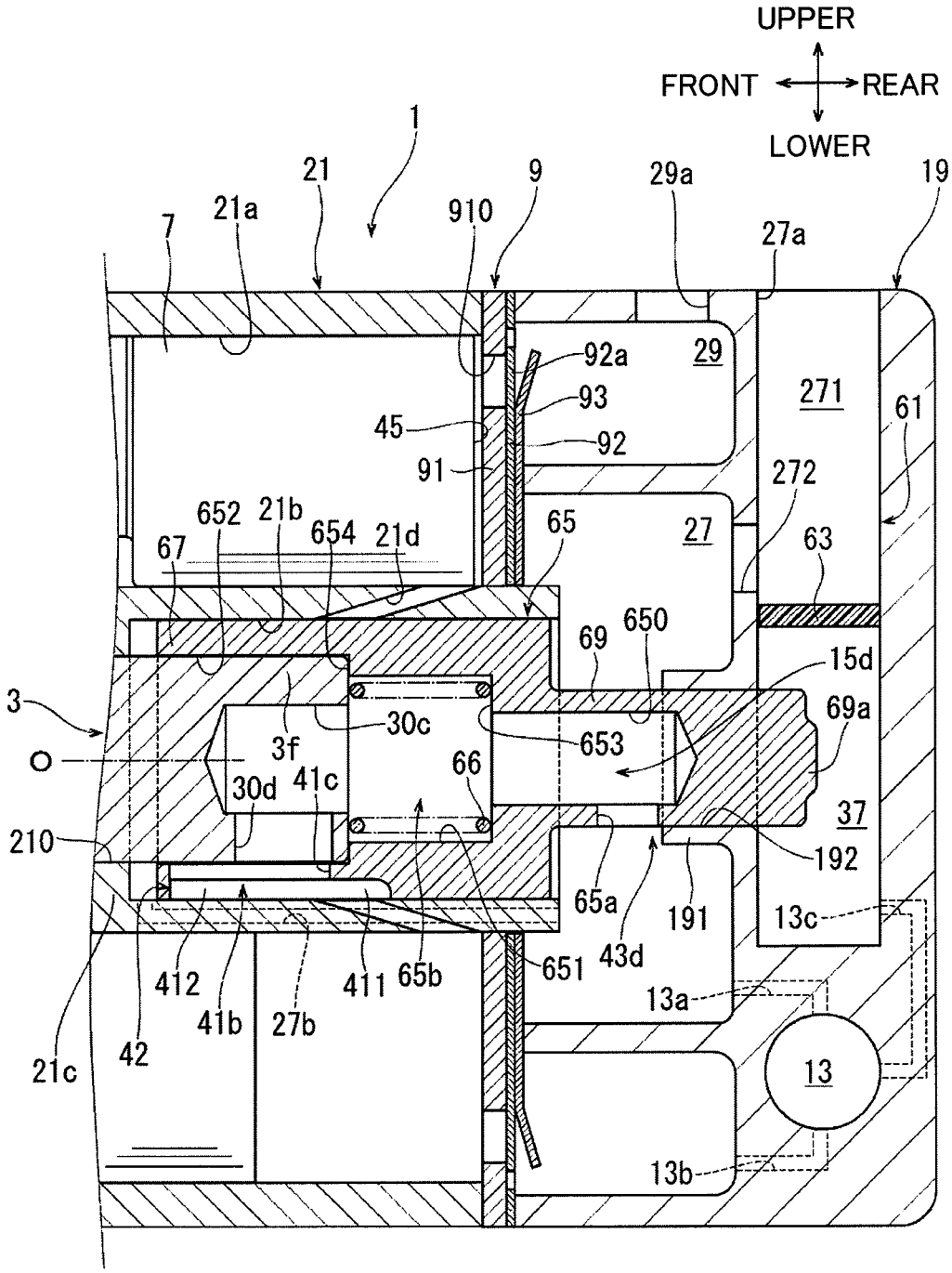
FIG. 15 is a partially enlarged longitudinal sectional view showing the suction throttle and its surroundings of the piston compressor of FIG. 14 at a maximum flow rate.
Figure 16:
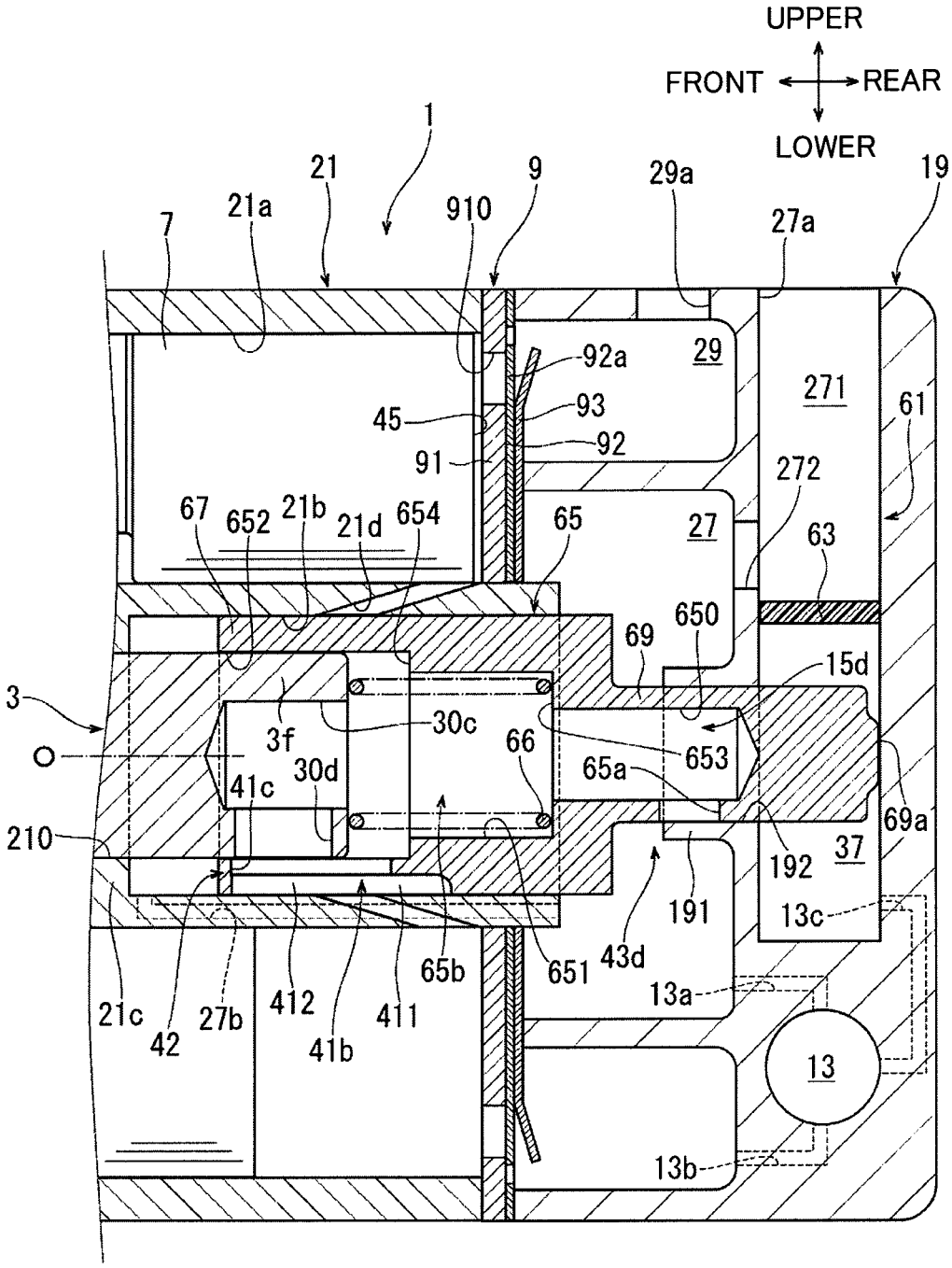
FIG. 16 is a partially enlarged longitudinal sectional view showing the suction throttle and its surroundings of the piston compressor of FIG. 14 at a minimum flow rate.

As shown in FIGS. 14 to 16, in the compressor according to a fourth embodiment, the rear housing 19 has a radial hole 61. The radial hole 61 extends from the center side of the rear housing 19 in the radially outward direction of the rear housing 19 and opens to the outside of the rear housing 19. A partition part 63 is fixed in the radial hole 61. The partition part 63 partitions the radial hole 61 into a first suction passage 271 and the control pressure chamber 37. The end portion of the first suction passage 271 in the radially outward direction of the rear housing 19 serves as a suction port 27*a*.

The rear housing 19 has a second suction passage 272. The second suction passage 272 communicates with the first suction passage 271 and the suction chamber 27. As a result, refrigerant gas is sucked into the suction chamber 27 through the suction port 27*a* and the first and second suction passages 271, 272. The suction chamber 27 communicates with the inside of the second axial hole 21*b* through the suction communication passage 27*b* formed in the cylinder block 21. As a result, suction pressure applies to the second axial hole 21*b* and the suction chamber 27.

The rear housing 19 has a third boss portion 191. The third boss portion 191 is an example of the boss portion of the present disclosure. The third boss portion 191 extends in the suction chamber 27 in the direction of the axis O. The rear housing 19 has a fourth axial hole 192. The fourth axial hole 192 is an example of the shaft hole of the present disclosure. The fourth axial hole 192 passes through the third boss portion 191 in the direction of the axis O and communicates with the suction chamber 27 and the control pressure chamber 37.

The drive shaft 3 has the threaded portion 3*a*, the first diameter portion 3*b*, and a third diameter portion 3*f*. The third diameter portion 3*f* is located on the rear side of the drive shaft 3 and is continuous with the rear end of the first diameter portion 3*b*. The third diameter portion 3*f* is supported in the third axial hole 210. The third diameter portion 3*f* has a larger diameter than the first diameter portion 3*b*. The third diameter portion 3*f* has a second axial passage 30*c* and a second radial passage 30*d*. The second axial passage 30*c* extends in third diameter portion 3*f* in the direction of the axis O. The rear end of the second axial passage 30*c* opens to the rear surface of the third diameter portion 3*f*. The second radial passage 30*d* communicates with the second axial passage 30*c*. The second radial passage 30*d* extends in third diameter portion 3*f* in the radial direction and opens to the outer circumferential surface of third diameter portion 3*f*.

As shown in FIGS. 15 and 16, the compressor according to the fourth embodiment includes a rotating body 65. The rotating body 65 has a main body portion 67 and an extending portion 69. The body portion 67 is formed to have substantially the same diameter as the second axial hole 21*b*. The extending portion 69 is integrally formed with the main body portion 67 and extends from the main body portion 67 rearward in the direction of the axis O. The extending portion 69 has a smaller diameter than the main body portion 67 and is formed to have substantially the same diameter as the fourth axial hole 192. The extending portion 69 has at the rear end thereof a protruding portion 69*a* protruding rearward.

The main body portion 67 of the rotating body 65 is disposed in the second axial hole 21*b*. As a result, suction pressure applies to the front surface of the main body portion 67. The extending portion 69 extends into the suction chamber 27 and is supported in the fourth axial hole 192. As a result, the rear end of the extending portion 69 including the protruding portion 69*a* enters the control pressure chamber 37. Accordingly, control pressure applies to the rear surface of the extending portion 69.

The rotating body 65 has the first radial passage 65*a* and the first axial passage 65*b*. The first radial passage 65*a* is formed in the extending portion 69 and extends in the radial direction of the rotating body 65 and opens to the outer circumferential surface of the extending portion 69. As a result, the first radial passage 65*a* communicates with the suction chamber 27.

The first axial passage 65*b* has a small diameter portion 650, a first large diameter portion 651, and a second large diameter portion 652. The small diameter portion 650 is formed from the inside of the main body portion 67 to the inside of the extending portion 69. The small diameter portion 650 extends in the direction of the axis O and communicates with the first radial passage 65*a* in the extending portion 69. That is, the first axial passage 65*b* communicates with the first radial passage 65*a*. The first large diameter portion 651 is formed in the main body portion 67. The first large diameter portion 651 extends in the direction of the axis O and communicates with the small diameter portion 650. The first large diameter portion 651 is formed larger in diameter than the small diameter portion 650. Thus, in the first axial passage 65*b*, a first stepped portion 653 is formed between the first large diameter portion 651 and the small diameter portion 650. The second large diameter portion 652 is formed in the main body portion 67. The second large diameter portion 652 extends in the direction of the axis O and the front end of the second large diameter portion 652 opens to the front surface of the main body portion 67 and the rear end of the second large diameter portion 652 communicates with the first large diameter portion 651. The second large diameter portion 652 is formed larger in diameter than the first large diameter portion 651. Thus, in the first axial passage 65*b*, a second stepped portion 654 is formed between the second large diameter portion 652 and the first large diameter portion 651.

The rotating body 65 is splined to the third diameter portion 3*f* of the drive shaft 3 in the second large diameter portion 652. As a result, the rotating body 65 is integrally rotatable with the drive shaft 3. In the rotating body 65, the main body portion 67 is movable in the direction of the axis O in the second axial hole 21*b* with respect to the drive shaft 3 by the differential pressure between the suction pressure and the control pressure. Then, the extending portion 69 is movable in the fourth axial hole 192 in the direction of the axis O. The third diameter portion 3*f* is splined to the second large diameter portion 652, so that the second axial passage 30*c* communicates with the first axial passage 65*b*.

As shown in FIG. 15, when the main body portion 67 moves at the most forward position in the second axial hole 21*b* in the direction of the axis O, the second stepped portion 654 comes into contact with the rear end of the third diameter portion 3*f*. As a result, the second stepped portion 654 regulates the amount of the forward movement of the rotating body 65. As shown in FIG. 16, when the extending portion 69 moves in the fourth axial hole 192 to the most rearward position in the direction of the axis O, the protruding portion 69*a* comes in contact with the inner wall of the control pressure chamber 37, or the rear housing 19. As a result, the rear housing 19 regulates the amount of the rearward movement of the rotating body 65.

In the first large diameter portion 651, a coil spring 66 is provided between the rear end of the third diameter portion 3*f* and the first stepped portion 653. The coil spring 66 urges the rotating body 65 toward the rear of the second axial hole 21*b*.

The main body portion 67 has the second communication passage 42, or, the main body passage 41*b* and the third radial passage 41*c*. In the compressor according to the fourth embodiment, as in the case of the compressors according to the second and third embodiments, the main body passage 41*b* is recessed on the outer circumferential surface of the main body portion 67 in a state in which the direction of the main body passage 41*b* is reversed from that in the compressor according to the first embodiment in the front-rear direction. The third radial passage 41*c* communicates with the second radial passage 30*d*. As in the case of the compressor according to the third embodiment, even when the main body portion 67 moves in the second axial hole 21*b* in the direction of the axis O, the communicating area between the third radial passage 41*c* and the second radial passage 30*d* is constant.

In the compressor according to the fourth embodiment, the suction unit 15*d* is constituted by the first communication passage 21*d*, the second communication passage 42, the first radial passage 65*a*, the first axial passage 65*b*, the second axial passage 30*c*, and the second radial passage 30*d*. As a result, in the compressor according to the present embodiment, refrigerant gas sucked into the suction chamber 27 reaches the third radial passage 41*c* from the first radial passage 65*a* through the first axial passage 65*b*, the second axial passage 30*c*, and the second radial passage 30*d*. The refrigerant gas that reaches the third radial passage 41*c* flows through the first communication passage 21*d* from the main body passage 41*b* and is sucked into each compression chamber 45.

The compressor according to the fourth embodiment, includes a suction throttle 43*d*. The suction throttle 43*d* is constituted by the first radial passage 65*a* and the third boss portion 191. The other configuration of the compressor according to the fourth embodiment, is the same as that of the compressor according to the first embodiment.

In the compressor according to the fourth embodiment, the control valve 13 increases the control pressure of the control pressure chamber 37 to increase the variable differential pressure, so that the body portion 67 of the rotating body 65 starts to move from the state shown in FIG. 16 in the second axial hole 21*b* forward in the direction of the axis O. The extending portion 69 of the rotating body 65 starts to move in the fourth axial hole 192 forward in the direction of the axis O. Thus, the first radial passage 65*a* starts to move forward of the third boss portion 191. As a result, in the suction throttle 43*d*, the opening degree of the first radial passage 65*a* gradually increases. Thus, the flow rate of refrigerant gas flowing from the suction chamber 27 into the first radial passage 65*a* gradually increases. As a result, the suction throttle 43*d* gradually increases the flow rate of refrigerant gas to each compression chamber 45. As the main body portion 67 moves in the second axial hole 21*b* forward in the direction of the axis O, the communication angle gradually decreases. Thus, the flow rate of refrigerant gas discharged from each compression chamber 45 into the discharge chamber 29 increases.

Then, when the variable differential pressure becomes maximum, as shown in FIG. 15, the entire first radial passage 65*a* is located in front of the third boss portion 191. As a result, in the suction throttle 43*d*, the opening degree of the first radial passage 65*a* becomes maximum, so that the flow rate of refrigerant gas flowing from the suction chamber 27 into the first radial passage 65*a* becomes maximum. Thus, the suction throttle 43*d* maximizes the flow rate of refrigerant gas to each compression chamber 45. In the case, the communication angle becomes minimum. Thus, in the compressor according to the fourth embodiment, the flow rate of refrigerant gas discharged from each compression chamber 45 into the discharge chamber 29 becomes maximum.

On the other hand, the control valve 13 reduces the control pressure of the control pressure chamber 37 to reduce the variable differential pressure, so that the body portion 67 starts to move in the second axial hole 21*b* rearward in the direction of the axis O due to the urging force of the coil spring 66. The extending portion 69 starts to move in the fourth axial hole 192 rearward in the direction of the axis O. Thus, the first radial passage 65*a* starts to move into the fourth axial hole 192 while the first radial passage 65*a* moves toward the rear of the third boss portion 191. That is, the first radial passage 65*a* starts to be covered by the third boss portion 191. As a result, in the suction throttle 43*d*, the opening degree of the first radial passage 65*a* gradually decreases. Thus, the flow rate of refrigerant gas flowing from the suction chamber 27 into the first radial passage 65*a* gradually decreases. As a result, the suction throttle 43*d* gradually decreases the flow rate of the refrigerant gas to each compression chamber 45. As the body portion 67 moves in the second axial hole 21*b* forward in the direction of the axis O, the communication angle gradually increases. Thus, the flow rate of refrigerant gas discharged from each compression chamber 45 into the discharge chamber 29 decreases.

Then, when the variable differential pressure becomes minimum, most part of the first radial passage 65*a* is covered with the third boss portion 191, as shown in FIG. 16. As a result, the opening degree of the first radial passage 65*a* becomes minimum in the suction throttle 43*d*, so that the flow rate of refrigerant gas flowing from the suction chamber 27 into the first radial passage 65*a* becomes minimum. Thus, the suction throttle 43*d* minimizes the flow rate of refrigerant gas into each compression chamber 45. In the case, the communication angle becomes maximum. Thus, in the compressor according to the fourth embodiment, the flow rate of refrigerant gas discharged from each compression chamber 45 into the discharge chamber 29 becomes minimum.

Fifth Embodiment

Figure 17:
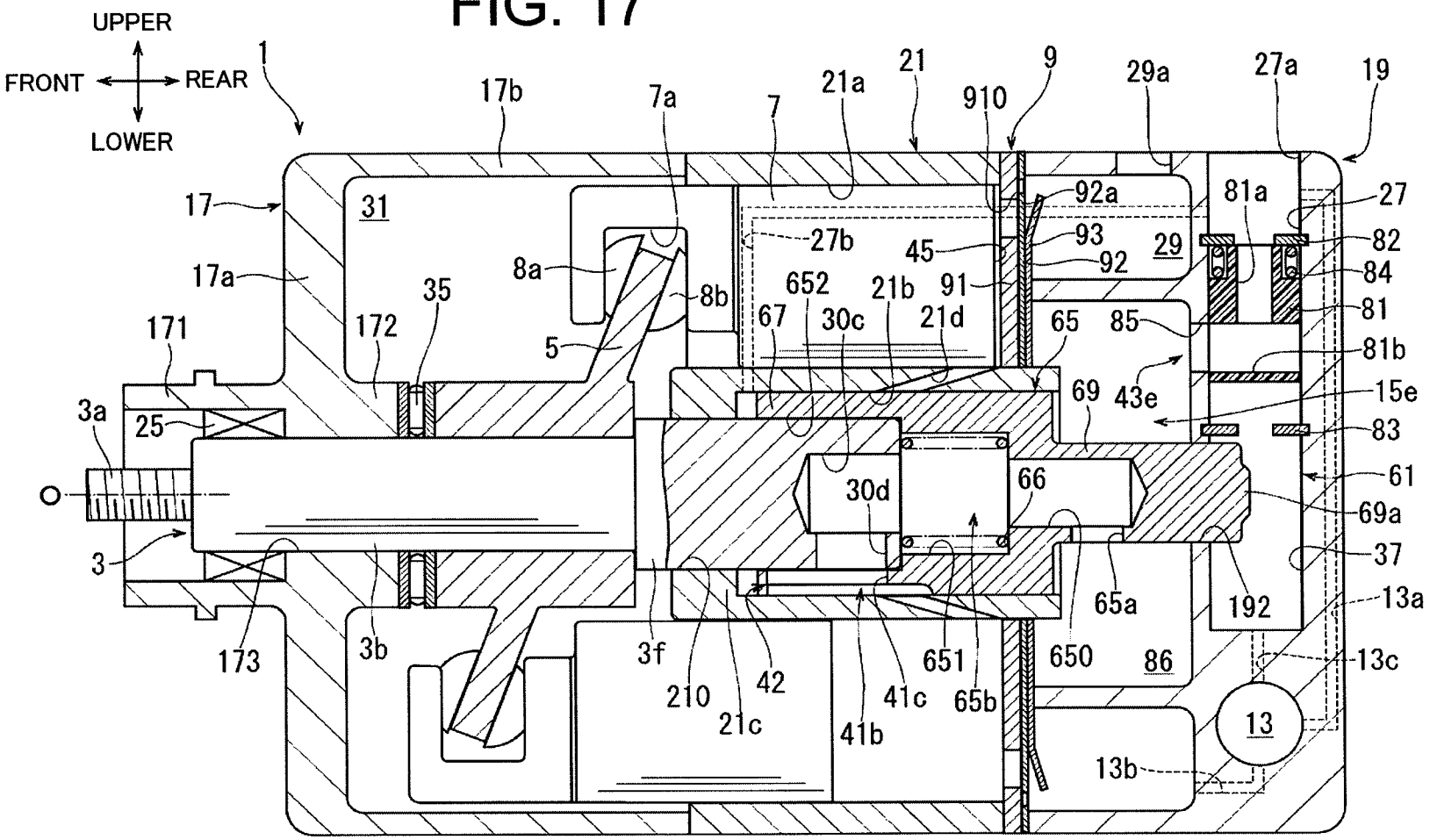
FIG. 17 is a longitudinal sectional view showing a piston compressor at a maximum flow rate, according to a fifth embodiment of the present disclosure.
Figure 18:
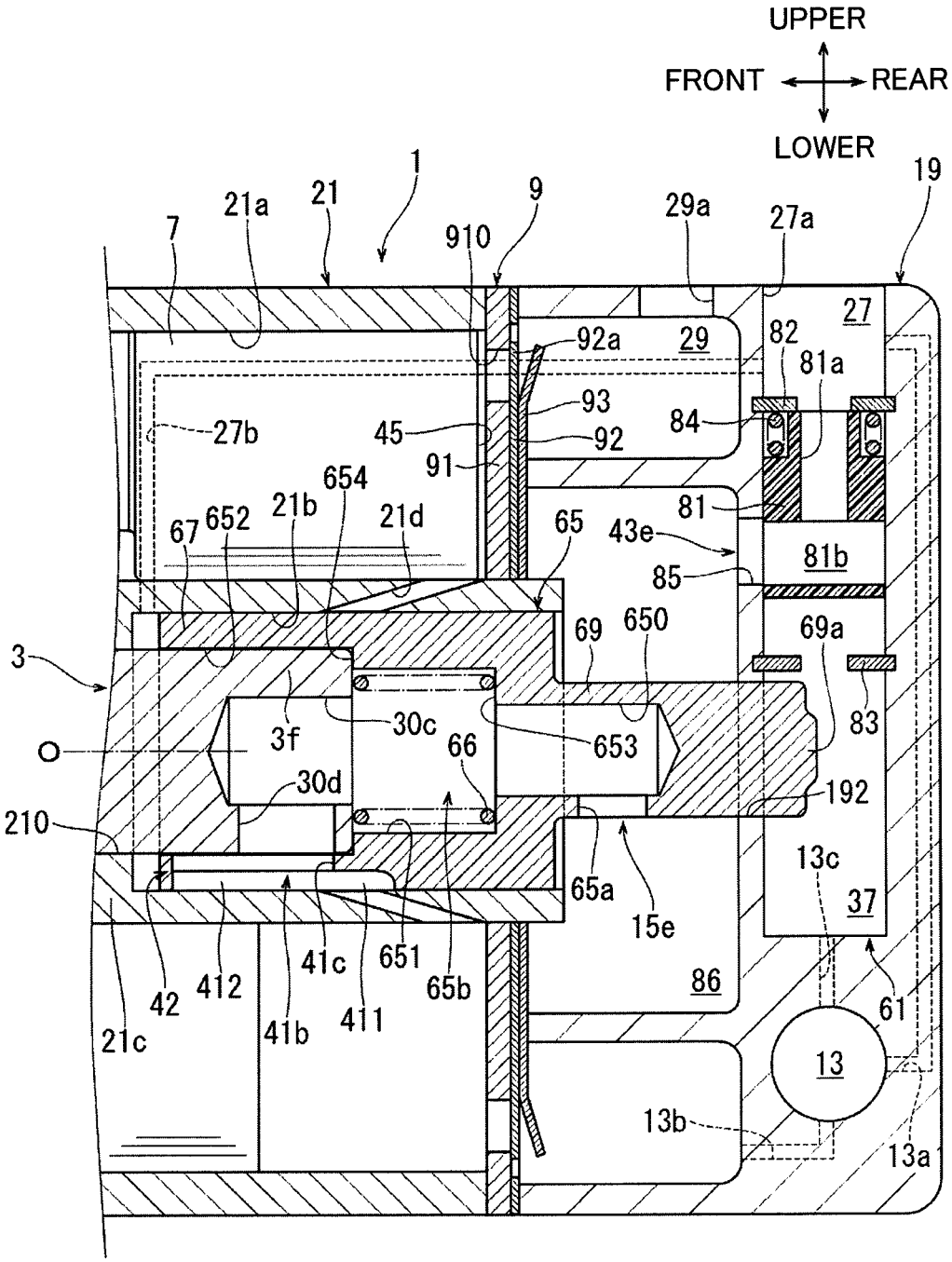
FIG. 18 is a partially enlarged longitudinal sectional view showing the suction throttle and its surroundings of the piston compressor of FIG. 17 at a maximum flow rate.
Figure 19:
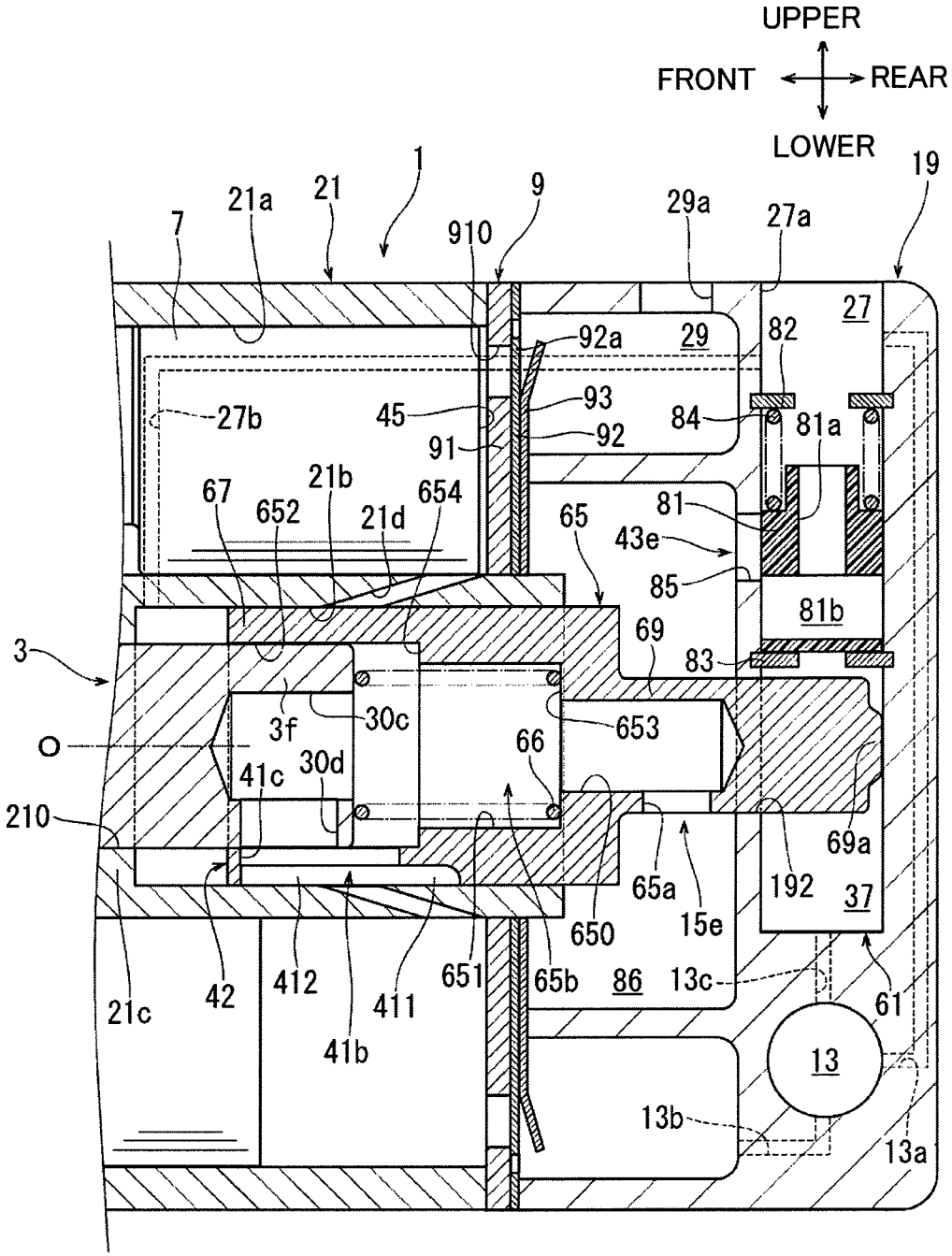
FIG. 19 is a partially enlarged longitudinal sectional view showing the suction throttle and its surroundings of the piston compressor of FIG. 17 at a minimum flow rate.

As shown in FIGS. 17 to 19, in the compressor according to a fifth embodiment, a suction valve 81 and circlips 82, 83 are provided in the radial hole 61 of the rear housing 19. The suction valve 81 is disposed between the circlips 82 and 83. The suction valve 81 partitions the radial hole 61 into the suction chamber 27 and the control pressure chamber 37. As a result, suction pressure applies to the suction chamber 27 on the side of the suction valve 81 and control pressure applies to the control pressure chamber 37 on the side of the suction valve 81. The end portion of the suction chamber 27, located in the radially outward direction of the rear housing 19, serves as the suction port 27*a*.

The suction valve 81 is movable in the suction chamber 27 in the radial direction of the rear housing 19, or in the vertical direction due to the differential pressure between the suction pressure and the control pressure in the radial hole 61, or the variable differential pressure. That is, the suction valve 81 is movable based on the control pressure. As shown in FIGS. 17 and 18, the suction valve 81 comes in contact with the circlip 82 when the suction valve 81 moves to the uppermost position in the suction chamber 27. As a result, the circlip 82 regulates the amount of the upward movement of the suction valve 81. As shown in FIG. 19, the suction valve 81 comes in contact with the circlip 83 when the suction valve 81 moves to the lowermost position in the suction chamber 27. As a result, the circlip 83 regulates the amount of the downward movement of the suction valve 81.

A coil spring 84 is provided between the suction valve 81 and the circlip 82. The coil spring 84 urges the suction valve 81 toward the lower side of the suction chamber 27, or toward the side of the control pressure chamber 37.

The suction valve 81 has a first through hole 81*a* and a second through hole 81*b*. The first through hole 81*a* extends in the direction intersecting with the direction of the axis O and opens on the upper surface of the suction valve 81. The second through hole 81*b* communicates with the first through hole 81*a* and extends in the direction of the axis O and passes through the suction valve 81.

The rear housing 19 has a suction passage 85 and a communication chamber 86. The suction passage 85 extends in the direction of the axis O and communicates with the second through hole 81*b*. As a result, the suction passage 85 communicates with the suction chamber 27 through the first and second through holes 81*a* and 81*b*. The communication chamber 86 is formed on the center side of the rear housing 19 and communicates with the suction passage 85. The communication chamber 86 communicates with the control pressure chamber 37 through the fourth axial hole 192.

In the compressor according to the fifth embodiment, the main body portion 67 of the rotating body 65 is disposed in the second axial hole 21*b*, so that the extending portion 69 extends into the communication chamber 86 and is supported in the fourth axial hole 192. As a result, the first radial passage 65*a* communicates with the communication chamber 86. In the compressor according to the present embodiment, unlike the compressor according to the fourth embodiment, the third boss portion 191 is not formed in the rear housing 19. Thus, if the extending portion 69 moves in the direction of the axis O, the communicating area between the first radial passage 65*a* and the communication chamber 86 is constant.

In the compressor according to the fifth embodiment, a suction unit 15*e* is constituted by the first communication passage 21*d*, the second communication passage 42, the suction valve 81, the suction passage 85, the communication chamber 86, the first radial passage 65*a*, the first axial passage 65*b*, the second axial passage 30*c* and the second radial passage 30*d*. As a result, in the compressor according to the present embodiment, refrigerant gas sucked into the suction chamber 27 reaches the communication chamber 86 through the first and second through holes 81*a*, 81*b* and the suction passage 85. The refrigerant gas that reaches the communication chamber 86 reaches the third radial passage 41*c* from the first radial passage 65*a* through the first axial passage 65*b*, the second axial passage 30*c*, and the second radial passage 30*d*. The refrigerant gas that reaches the third radial passage 41*c* flows through each of the first communication passages 21*d* from the main body passage 41*b* and is sucked into each compression chamber 45.

The compressor according to the fifth embodiment, has a suction throttle 43*e*. The suction throttle 43*e* is constituted by the suction valve 81 and the suction passage 85. The other configuration of the compressor according to the fifth embodiment, is the same as that of the compressor according to the fourth embodiment.

In the compressor according to the fifth embodiment, the control valve 13 increases the control pressure of the control pressure chamber 37 to increase the variable differential pressure, so that the suction valve 81 starts to move upward in the suction chamber 27 from the state shown in FIG. 19 against the urging force of the coil spring 84. As a result, in the suction throttle 43*e*, the suction valve 81 moves upward with respect to the suction passage 85, so that the communicating area between the suction passage 85 and the second through hole 81*b* gradually increases. Thus, the flow rate of refrigerant gas flowing from the second through hole 81*b* through the suction passage 85 into the communication chamber 86 gradually increases. As a result, the suction throttle 43*e* gradually increases the flow rate of refrigerant gas into each compression chamber 45.

When the variable differential pressure becomes maximum, as shown in FIG. 18, the suction valve 81 is located at the uppermost position in the suction chamber 27. As a result, the communication area between the suction passage 85 and the second through hole 81*b* becomes maximum in the suction throttle 43*e*. Thus, the flow rate of refrigerant gas flowing from the second through hole 81*b* through the suction passage 85 into the communication chamber 86 becomes maximum. As a result, the suction throttle 43*e* maximizes the flow rate of refrigerant gas into each compression chamber 45. The movement of the main body portion 67 in the second axial hole 21*b* and the movement of the extending portion 69 in the fourth axial hole 192 when the variable differential pressure increases are the same as those of the compressor according to the fourth embodiment. Thus, in the compressor according to the fifth embodiment, the flow rate of refrigerant gas discharged from each compression chamber 45 into the discharge chamber 29 becomes maximum.

On the other hand, the control valve 13 decreases the control pressure of the control pressure chamber 37 to reduce the variable differential pressure, so that the suction valve 81 moves downward in the suction chamber 27 due to the urging force of the coil spring 84 in the suction chamber 27. As a result, in the suction throttle 43*e*, the suction valve 81 moves downward with respect to the suction passage 85, so that the communicating area between the suction passage 85 and the second through hole 81*b* gradually decreases. Thus, the flow rate of refrigerant gas flowing from the second through hole 81*b* through the suction passage 85 into the communication chamber 86 gradually decreases. Thus, the suction throttle 43*e* gradually decreases the flow rate of refrigerant gas into each compression chamber 45.

When the variable differential pressure becomes minimum, as shown in FIG. 19, the suction valve 81 is located at the lowermost position in the suction chamber 27. As a result, in the suction throttle 43*e*, the second through hole 81*b* serves as the suction passage 85 only at a small portion, so that the communicating area between the suction passage 85 and the second through hole 81*b* becomes minimum. Thus, the flow rate of refrigerant gas flowing from the second through hole 81*b* through the suction passage 85 into the communication chamber 86 becomes minimum. Thus, the suction throttle 43*e* minimizes the flow rate of refrigerant gas into each compression chamber 45. The movement of the main body portion 67 in the second axial hole 21*b* and the movement of the extending portion 69 in the fourth axial hole 192 when the variable differential pressure decreases are the same as those of the compressor according to the fourth embodiment. Thus, in the compressor according to the fifth embodiment, the flow rate of refrigerant gas discharged from each compression chamber 45 into the discharge chamber 29 becomes minimum.

In the compressor according to the fifth embodiment, the communicating area between the suction passage 85 and the second through holes 81*b* changes in the suction throttle 43*e* independently of the movement of the main body portion 67 and the extending portion 69 in the direction of the axis O, or the movement of the rotating body 65 in the direction of the axis O so that the flow rate of refrigerant gas into each compression chamber 45 increases or decreases. Thus, in the compressor according to the present embodiment, the flow rate of the refrigerant gas into each compression chamber 45 is suitably adjustable.

Thus, the compressors according to the second to the fifth embodiments have the same function as the compressor according to the first embodiment.

Although the present disclosure has been described with reference to the first to the fifth embodiments, the present disclosure is not limited to the above-mentioned first to the fifth embodiments, but may be modified within the scope of the present disclosure.

For example, the compressors according to the second to the fifth embodiments may be configured as a double-headed piston compressor.

The compressor according to the first embodiment, may be configured so that the rotating body 11 moves forward in the second axial hole 21*b* in the direction of the axis O, so that the flow rate of refrigerant gas discharged from each compression chamber 45 into the discharge chamber 29 increases.

The compressors according to the first to the fifth embodiments, may adopt a wobble type conversion unit in which a swing plate is supported on the rear side of the fixed swash plate 5 via a thrust bearing instead of the shoes 8*a* and 8*b* and the wobble plate and each piston 7 are connected by a connecting rod.

In the compressors according to the first to the fifth embodiments, the control pressure may be controlled externally by on-off control of external current to the control valve 13, or the control pressure may be controlled internally without using external current. For the external control of the control pressure, each compressor may be configured such that the opening degree of the control valve 13 is decreased by shut-off of the control valve 13 from the current. This configuration allows the opening degree of the control valve 13 to decrease and the control pressure in the control pressure chamber 37 to decrease during the stop of the compressor, thereby allowing the compressor to start in a state in which the flow rate of the refrigerant gas discharged from each compression chamber 45 to the discharge chamber 29 is minimum, and reducing a shock caused by starting the compressor.

The compressors according to the first to the fifth embodiments may perform an outlet-side control such that the control valve 13 changes a flow rate of the refrigerant gas introduced from the control pressure chamber 37 into the suction chamber 27 or the swash plate chamber 31 through the bleed passage. This enables the amount of the refrigerant gas in the discharge chamber 29, which is used for changing the flow rate of the refrigerant discharged from each compression chamber 45 to the discharge chamber 29, to be decreased, and thus increases the efficiency of the compressor. In this case, the compressor may be configured such that the opening degree of the control valve 13 is increased by shut-off of the control valve 13 from the current. This configuration allows the opening degree of the control valve 13 to increase and the control pressure in the control pressure chamber 37 to decrease during the stop of the compressor, thereby allowing the compressor to start in the state in which the flow rate of the refrigerant gas discharged from each compression chamber 45 to the discharge chamber 29 is minimum, and reducing a shock caused by starting the compressor.

The compressors according to the first to the fifth embodiments may include a three-way valve that adjusts the opening degrees of bleeding and supply passages, instead of the control valve 13.

The present disclosure can be used for a vehicle air conditioner.

What is claimed is:

1. A piston compressor including a suction throttle, the piston compressor comprising:

a housing including a cylinder block having a plurality of cylinder bores, the housing having a discharge chamber, a swash plate chamber, and an axial hole;

a drive shaft rotatably supported in the axial hole;

a fixed swash plate rotatable in the swash plate chamber by rotation of the drive shaft, wherein an inclination angle of the fixed swash plate with respect to a plane perpendicular to an axis of the drive shaft is constant;

a plurality of pistons forming a plurality of compression chambers in the respective cylinder bores and coupled to the fixed swash plate;

a discharge valve discharging refrigerant gas in the compression chambers into the discharge chamber;

a rotating body provided on the drive shaft and rotatable integrally with the drive shaft and movable in a direction of the axis of the drive shaft with respect to the drive shaft based on a control pressure; and a control valve configured to control the control pressure, wherein the cylinder block has a plurality of first communication passages communicating with the respective cylinder bores, wherein the rotating body has a second communication passage that communicates with the first communication passages intermittently by the rotation of the drive shaft, wherein a flow rate of refrigerant gas discharged from the compression chambers into the discharge chamber decreases when a communication angle around the axis, at which the second communication passage communicates with the first communication passages, increases per one rotation of the drive shaft depending on a position of the rotating body in the direction of the axis, wherein the piston compressor includes the suction throttle that decreases a flow rate of refrigerant gas into the compression chambers when the communication angle increases based on the control pressure, wherein the housing has a suction port that opens to an outside of the housing, and wherein the suction throttle is disposed in a passage from the suction port to the second communication passage, and the suction throttle is operable to change a communicating area of the passage.

2. The piston compressor according to claim 1, wherein the housing has a suction chamber, a suction passage communicating with the suction chamber, and a communication chamber communicating with the suction passage, wherein a suction valve is provided in the housing and movable based on the control pressure, wherein the rotating body has a first radial passage extending in a radial direction of the rotating body and communicating with the communication chamber and a first axial passage extending in the direction of the axis and communicating with the first radial passage, wherein the drive shaft has a second axial passage extending in the direction of the axis and communicating with the first axial passage and a second radial passage extending in a radial direction of the drive shaft and communicating with the second axial passage and the second communication passage, and wherein the suction throttle is constituted by the suction passage and the suction valve.

3. The piston compressor according to claim 1, wherein the suction throttle decreases the flow rate of refrigerant gas into the compression chambers when the communication angle increases based on movement of the rotating body in the direction of the axis.

4. The piston compressor according to claim 3, wherein the housing has a suction passage formed in the axial hole, wherein the rotating body has a first valve body fixed to the drive shaft and a second valve body having the second communication passage and movable with respect to the first valve body in the direction of the axis based on the control pressure, wherein the second valve body has a valve main body rotatable integrally with the first valve body and movable in the axial hole in the direction of the axis and a valve hole that is formed integrally with the valve main body and through which the first valve body is inserted, wherein the valve main body has an annular passage communicating with the second communication passage and communicating with the suction passage through the valve hole, and wherein the suction throttle is constituted by the first valve body and the valve hole.

5. The piston compressor according to claim 3, wherein the rotating body is provided on an outer circumferential surface of the drive shaft, wherein the drive shaft has a supply passage and a connecting passage communicating with the second communication passage, wherein a moving body is provided in the supply passage and is movable in the direction of the axis based on the control pressure, wherein the moving body has a through passage communicating with the supply passage and the connecting passage, and wherein the suction throttle is constituted by the connecting passage and the through passage.

6. The piston compressor according to claim 3, wherein the housing has a suction chamber and a boss portion extending in the suction chamber in the direction of the axis, wherein the rotating body has a first radial passage extending in a radial direction of the rotating body and communicating with the suction chamber and a first axial passage extending in the direction of the axis and communicating with the first radial passage, wherein the drive shaft has a second axial passage extending in the direction of the axis and communicating with the first axial passage and a second radial passage extending in the radial direction of the drive shaft and communicating with the second axial passage and the second communication passage, and wherein the suction throttle is constituted by the first radial passage and the boss portion.

7. The piston compressor according to claim 3, wherein the rotating body is provided on an outer circumferential surface of the drive shaft, wherein the second communication passage has a first radial passage that opens to an inner circumferential surface of the rotating body and extends in a radial direction of the rotating body and a main body passage that is recessed on an outer circumferential surface of the rotating body and communicates with the first radial passage, wherein the drive shaft has an axial passage that extends in the direction of the axis and a second radial passage that communicates with the axial passage and extends in a radial direction of the drive shaft and opens to the outer circumferential surface of the drive shaft, and wherein the suction throttle is constituted by the first radial passage and the second radial passage.

* * * * *